US011097339B2

(12) United States Patent
Nishida et al.

(10) Patent No.: US 11,097,339 B2
(45) Date of Patent: Aug. 24, 2021

(54) CASTING PLANT AND METHOD FOR MANAGING DATA FOR MOLDING MOLDS AND DATA ON CONDITIONS OF MOLTEN METAL IN CASTING PLANT

(71) Applicants: SINTOKOGIO, LTD., Aichi (JP); FUJIWA DENKI CO., LTD., Aichi (JP)

(72) Inventors: Tadashi Nishida, Aichi (JP); Toshiyuki Hyodo, Aichi (JP); Koichi Kato, Aichi (JP); Kazuhiro Ota, Aichi (JP)

(73) Assignees: SINTOKOGIO, LTD., Aichi (JP); FUJIWA DENKI CO., LTD., Aichi (JP)

( * ) Notice: Subject to any disclaimer, the term of this patent is extended or adjusted under 35 U.S.C. 154(b) by 596 days.

(21) Appl. No.: 15/775,962

(22) PCT Filed: Nov. 16, 2015

(86) PCT No.: PCT/JP2015/082127

§ 371 (c)(1),
(2) Date: May 14, 2018

(87) PCT Pub. No.: WO2017/085765

PCT Pub. Date: May 26, 2017

(65) Prior Publication Data

US 2019/0247917 A1 Aug. 15, 2019

(51) Int. Cl.
*B22D 47/02* (2006.01)
*B22D 46/00* (2006.01)

(52) U.S. Cl.
CPC ..... *B22D 47/02* (2013.01); *B22D 46/00* (2013.01)

(58) Field of Classification Search
CPC ..... B22D 47/02; B22D 46/00; B22D 35/04; B22D 41/12
See application file for complete search history.

(56) References Cited

U.S. PATENT DOCUMENTS

2002/0050332 A1 5/2002 Cantwell

FOREIGN PATENT DOCUMENTS

JP 1-262064 A 10/1989
JP 1-262065 10/1989
(Continued)

OTHER PUBLICATIONS

International Search Report issued in International Application No. PCT/JP2015/082127, mailed from the Japan Patent Office dated Jan. 19, 2016.

(Continued)

*Primary Examiner* — Kevin P Kerns
*Assistant Examiner* — Steven S Ha
(74) *Attorney, Agent, or Firm* — Finnegan, Henderson, Farabow, Garrett & Dunner, LLP

(57) ABSTRACT

A casting plant to produce a cast product with a high quality and a method for managing data for molding the mold and data on the conditions of the molten metal in the casting plant are provided. The controller (11) for the molding unit issues a serial number for the mold to a mold (M). The controller (31) for the unit for conveying the molds shifts the serial number for the mold in accordance with a movement of the mold. It also gathers data on the mold and links the data for molding the mold with the serial number for the mold. When the molten metal is poured from the ladle into the mold, the controller (71) for the unit for pouring the molten metal sends to the computer (91) for controlling the casting plant the serial number for the ladle that is linked with the data on the conditions of the molten metal and that is linked with the serial number for the mold.

20 Claims, 15 Drawing Sheets

(56) References Cited

FOREIGN PATENT DOCUMENTS

| | | | |
|---|---|---|---|
| JP | 11-207458 | | 8/1999 |
| JP | WO 2010/146908 | A1 | 12/2012 |
| JP | 5586115 | | 8/2014 |
| JP | 2015-033712 | A | 2/2015 |
| KR | 10-2015-0086379 | | 7/2015 |
| WO | WO 2011/030618 | A1 | 3/2011 |
| WO | WO 2015/072323 | A1 | 5/2015 |

OTHER PUBLICATIONS

Supplementary European Search Report dated Apr. 8, 2019 issued by The Hague in European Application No. 15 90 8705.
Korean Office Action dated Jun. 15, 2021, issued in corresponding Korean Application No. 10-2018-7013798 by the Korean Intellectual Property Office.

(A)

11(a) molding machine, device for engraving 11 (b) machine for measuring sand properties 11 controller for molding unit
[measurement]
sand properties, weight of supplied sand, rate of compression, pressure for squeezing, period of time for squeezing, thickness of mold

Fig. 7

(B)

| | |
|---|---|
| | [issuance]<br>serial number for mold, position of mold, serial number for individual piece, linking data on mold with serial number for mold |
| 31(a) | unit for conveying molds, sensor for detecting position of mold, forming air vent, forming sprue, setting core |
| 31 | controller for unit for conveying molds<br>[measurement]<br>cooling time, conveying molds, information on air vent, information on sprue, information on core<br>[issuance]<br>serial number for mold that is shifted to position of mold |
| 51 | controller for unit for transporting molten metal<br>[measurement, receiving]<br>time after receiving molten metal, time when receiving molten metal, reference number of furnace, number of each tapping from furnace, weight of received molten metal, temperature of received molten metal, reference number of material, period of time to fade, conveying mold<br>[issuance]<br>serial number for ladle that is shifted to position of ladle, linking data on molten metal with serial number for ladle |
| 51(a) | ladle for pouring, bogie for transporting ladle for pouring, sensor for detecting ladle, ladle for reacting, bogie for receiving molten metal that has mechanism for transferring molten metal |
| 61 | controller for unit for feeding alloyed metal<br>[measurement]<br>kind of alloyed metal, weight of alloyed metal, time of putting alloyed metal<br>[issuance] |

Fig. 7

(C)

serial number for ladle, linking data on alloyed metal with serial number of ladle 61(a) device for feeding alloyed metal 71 controller for unit for pouring molten metal
[measurement]
weight of poured molten metal, time of pouring, quantity of unused molten metal, pouring weight, temperature of poured molten metal
[issuance]
linking serial number for mold with serial number for ladle, serial number for TP, linking serial number for ladle with serial number for TP, error signal showing elapsed period of time to fade, error signal by inconsistency of material based on plan for molten metal with material linked by serial number for ladle 71(a) pouring machine 71(b) unit for collecting test piece 91 computer for controlling casting plant
[input] data on plans
[input] relevant data
【relevant data on serial number for mold】
molding plan, sand properties, pressure for squeezing, etc.
【relevant data on serial number for ladle】
kind of alloyed metal, weight of alloyed metal, reference number of furnace, reference number of material, etc.

CASTING PLANT AND METHOD FOR MANAGING DATA FOR MOLDING MOLDS AND DATA ON CONDITIONS OF MOLTEN METAL IN CASTING PLANT

TECHNICAL FIELD

The present invention relates to a casting plant and a method for managing data for molding molds and data on conditions of molten metal in the casting plant to produce cast products with a high quality.

BACKGROUND ART

A cast product is produced by molding molds, conveying the molds to a position where molten metal can be poured into molds, and pouring the molten metal into the molds. Thus facilities for adjusting molding sand, for molding the molds, and for conveying the molds, are installed in a foundry. Facilities are also installed for hot molten metal to be received by a ladle, which molten metal is melted in a melting furnace, for transporting the ladle that has received the molten metal to a position to pour the molten metal, and for pouring the molten metal into a mold at the position to pour the molten metal. Further, facilities are installed for cooling the molten metal in the molds and for separating a cast product from the molding sand. These facilities have different requirements for different kinds of cast products. The layouts of them are different for different kinds of casting plants.

Thus each of the facilities is individually designed and manufactured and has a dedicated controller. But the information that is controlled by the controllers is not effectively linked between the controllers. Currently such information is not thoroughly utilized to produce a cast product with a high quality.

For example, Patent Literature 1 discloses a process for supplying molten metal, wherein the quantity of molten metal to be supplied to an automatic pouring machine is controlled based on the number of molds that have been produced by a molding machine. This process is suitable for pouring molten metal into a group of molds that have been produced at a high rate, based on the number of molds and the remaining molten metal in a ladle. However, it is insufficient for a casting plant or a process for controlling data to produce a cast product with a high quality. For a casting plant, while requirements for a high rate of production and a high-mix low-volume production have been increasing, the necessity to produce a cast product with a high quality has also been increasing.

The present invention aims to provide a casting plant and a method for managing data to produce a cast product with a high quality while meeting the requirements for a high rate of production and a high-mix low-volume production.

PRIOR-ART PUBLICATION

Patent Literature

Patent Literature 1: Japanese Patent No. 5586115

DISCLOSURE OF INVENTION

To solve the above-mentioned problems, as shown in FIGS. 1, 2, 3, and 7, a casting plant of the first aspect of the invention is the casting plant 1, wherein a mold M is molded and conveyed to a position P6 where molten metal can be poured into molds, and wherein the molten metal is poured into the mold M to produce a cast product. It comprises a molding unit 10 that molds the mold M from molding sand. It also comprises a unit 30 for conveying molds that conveys the mold M. It also comprises a unit 70 for pouring the molten metal that pours the molten metal into the mold M that has been conveyed by means of the unit 30 for conveying the molds. It also comprises a computer 91 for controlling the casting plant 1. The molding unit 10 has a molding machine 14 that molds the mold M and a controller 11 for the molding unit that controls operations of the molding machine 14. The controller 11 for the molding unit receives data on a molding plan from the computer 91 for controlling the casting plant to control the molding machine 14 so that the mold M is molded based on the molding plan that is derived from the data on the molding plan. It issues a serial number for the mold that has been molded and links the data on the mold M with the serial number for the mold. The unit 30 for conveying the molds has a mechanism 38 for conveyance that intermittently conveys the molds by a distance to the next mold, a sensor 39 for detecting the position of the mold that detects the mold M that has been conveyed, and a controller 31 for the unit for conveying the molds that controls operations of the unit 30 for conveying the molds. The controller 31 for the unit for conveying the molds controls the mechanism 38 for conveyance so that the molds M are intermittently conveyed. It receives the serial number for the mold M, which mold has been molded by the molding machine 14 and is ready to be conveyed by the mechanism 38 for conveyance. It sequentially shifts each serial number for the mold that is assigned to the position of the mold M that stops in accordance with a movement of the mold M, which is detected by means of the sensor 39 for detecting the position of the mold, so that the serial number for the mold M, which serial number is assigned to the position of the mold, accords with the actual position of the mold. The unit 70 for pouring the molten metal has a pouring machine 72 that pours molten metal from a ladle L2 for pouring into the mold M and a controller 71 for the unit for pouring the molten metal that controls operations of the pouring machine 72. The controller 71 for the unit for pouring the molten metal receives a serial number for the ladle that is linked with the data on the conditions of the molten metal in the ladle L2 for pouring. It also receives from the controller 31 for the unit for conveying the molds the serial number for the mold M that is located at the position PG to pour the molten metal. It controls the pouring machine 72 so that the molten metal is poured based on a pouring plan that is derived from the data on the pouring plan that corresponds to the serial number for the mold. It links the serial number for the ladle L2 for pouring, which ladle is used for pouring, with the serial number for the mold, to send them to the computer 91 for controlling the casting plant.

By this configuration, information on a mold can be utilized by linking it with a serial number for a mold that is issued to each mold and by shifting the serial number for the mold each time the molds are intermittently conveyed. Information on the molten metal is linked with a serial number for each ladle. When the molten metal is poured into a mold by means of the pouring machine, the serial number for the mold that is located at the position to pour the molten metal is linked with the serial number for the ladle from which the molten metal is poured into the mold. Then these serial numbers are sent to the computer to control the casting plant. Thus both the data on the mold and the data on the conditions of the molten metal can be managed by using a combination of the serial number for the mold and the serial number for the ladle that is linked with the serial number for the mold. Conventionally, in a foundry, the molding machine, the apparatus for conveying the molds, the apparatus for conveying the molten metal, the pouring machine, and so on, are individually controlled as discussed above, so that operators control the respective machines or apparatuses to operate the entire casting plant. Especially, since a lot of molds are continuously molded and conveyed, it is difficult to understand the status of the molds that are conveyed and to manage them by identifying their positions. By the present invention the molds are managed based on the positions of them as they are intermittently conveyed. The molten metal is managed based on a ladle that transports the molten metal. Further, in managing the data for molding the molds and the data on the conditions of the molten metal in the casting plant, data on the molds are gathered for each mold while the status of the molds that are intermittently conveyed is analyzed and the data on the molten metal are gathered for each ladle while the status of the ladles that are transported is being analyzed. When the molten metal is poured into the mold, the data on the molds and the data on the molten metal are combined to be managed. By the casting plant of the first aspect of the present invention the data on the molding machine can be linked with the mold that has been molded by the molding machine to be managed. Further, each of the molds on a line for molding can be individually identified and thereby be managed.

Regarding the casting plant of the second aspect of the invention, as shown in FIGS. 1, 2, 4, 5, and 7 the casting plant 1 of the first aspect further comprises a unit 50 for transporting the molten metal to transport the molten metal from the furnace F to the pouring machine 72. The unit 50 for transporting the molten metal has a ladle L1 for reacting that receives the molten metal from the furnace F and transfers the molten metal to the ladle L2 for pouring. It also has a device 60 for feeding an alloyed metal that puts an alloyed metal into the ladle L1 for reacting. It also has the ladle L2 for pouring, to which the molten metal that has reacted with the alloyed metal is transferred from the ladle for reacting, and which ladle for pouring is transported to the pouring machine 72. It also has a bogie 52 for receiving molten metal that has a mechanism for transferring the molten metal. The bogie 52 transports the ladle L1 for reacting to a position P1 for putting the alloyed metal where the alloyed metal is put from the device 60 for feeding an alloyed metal into the ladle L1 for reacting, to a position P2 for receiving the molten metal where the ladle L1 for reacting receives the molten metal from the furnace F, and to a position P4 for transferring the molten metal where the molten metal is transferred from the ladle L1 for reacting to the ladle L2 for pouring. It also has a bogie 54 for transporting the ladle for pouring, which bogie transports the ladle L2 for pouring to the position P4 for transferring the molten metal and to a position P5 for transferring the ladle where the ladle L2 for pouring is transferred to the pouring machine 72. It also has a sensor 59, 523, 543 for detecting the ladle, which sensor is located at a position of the ladle L1 for reacting or a position of the ladle L2 for pouring, to detect the ladle that is transported thereto. It also has a controller 61 for the device for feeding an alloyed metal, which controller controls the device 60 for feeding an alloyed metal so that a quantity of an alloyed metal is put into the ladle L1 for reacting, issues a serial number for a ladle to the ladle L1 for reacting into which the alloyed metal is put, and links data on the alloyed metal with the serial number for the ladle. It also has a controller 51 for the unit for transporting the molten metal, which controller 51 controls the bogie 52 for receiving molten metal that has a mechanism for transferring the molten metal and controls the bogie 54 for transporting the ladle for pouring, to transport the ladle L1 for reacting and the ladle L2 for pouring based on a plan for transporting the ladle and to transfer the molten metal from the ladle L1 for reacting to the ladle L2 for pouring. The controller 51 shifts the serial number for the ladle. The serial number is assigned to the position of the ladle based on the position of the ladle detected by the sensor 59, 523, 5443 for detecting the ladle, so that the serial number for the ladle L1 for reacting or the ladle L2 for pouring that is located at that position corresponds to the position of the ladle. The controller 51 links the data on the conditions of the molten metal within the ladle L1 for reacting with the serial number for the ladle. The controller 51 for the unit for transporting the molten metal sends the serial number for the ladle L2 for pouring that has been transferred to the pouring machine 72 to the controller 71 for the unit for pouring the molten metal.

By this configuration, since the serial number for the ladle is issued to the ladle in which the alloyed metal is put, the serial number for the ladle can be issued to each batch of the alloyed metal that has been put in the ladle and that has a significant effect on the properties of the molten metal. The data on the conditions of the molten metal, which are information on the molten metal in the ladle, are linked with the serial number for the ladle. When the ladle for pouring, into which the molten metal is transferred from the ladle for reacting, is transferred to the pouring machine, the serial number for the ladle is sent to the controller for the unit for pouring the molten metal. Thus the serial number for the ladle that is utilized by the controller for the unit for pouring the molten metal definitely corresponds to the information on the molten metal.

Regarding the casting plant of the third aspect of the invention, as shown in FIGS. 7, 11, 12, and 13 the casting plant 2 of the first aspect further comprises a unit 70 for transporting the molten metal that transports the molten metal from the furnace F to the pouring machine 72. The unit 70 for transporting the molten metal has the ladle L2 for pouring that receives the molten metal from the furnace F and that is transferred to the pouring machine 72. It also has a device 60 for feeding an alloyed metal that puts the alloyed metal into the ladle L2 for pouring. It also has a bogie 54 for transporting the ladle for pouring that transports the ladle L2 for pouring to a position P1 for putting the alloyed metal where the alloyed metal is put from the device 60 for feeding the alloyed metal into the ladle L2 for pouring, to a position P2 for receiving the molten metal where the ladle L2 for pouring receives the molten metal from the furnace F, and to a position P5 for transferring the ladle where the ladle L2 for pouring is transferred to the pouring machine 72. It also has a sensor 59, 843 for detecting the ladle, which sensor is provided at a position of the ladle L2 for pouring that is transported; and which sensor detects the ladle L2 for pouring that has been transported. It also has a controller 61 for the device for feeding an alloyed metal, which controller controls the device 60 for feeding an alloyed metal so as to put a quantity of an alloyed metal into the ladle L2 for pouring, and which controller issues a serial number for the ladle to the ladle L2 for pouring into which the alloyed metal has been put and links data on the alloyed metal with the serial number for the ladle. It also has a controller 51 for the unit for transporting the molten metal, which controller controls the bogie 54 for transporting the ladle for pouring so as to transport the ladle L2 for pouring based on a plan for transporting the ladle, which controller shifts the serial number for the ladle that is assigned to the position P1, P2, P5 for the ladle based on a movement of the ladle L2 for pouring that is detected by means of the sensor 59, 843 for detecting the ladle, so that the serial number for the ladle for pouring corresponds with the position of the ladle, the ladle for pouring being at the position of the ladle, and which controller links the data on the molten metal within the ladle L2 for pouring with the serial number for the ladle for pouring. The controller 51 for the unit for transporting the molten metal sends the serial number for the ladle L2 for pouring that has been transferred to the pouring machine 72 to the controller 71 for the unit for pouring the molten metal.

By this configuration, since a serial number for a ladle is issued to the ladle for pouring into which the alloyed metal is put, a serial number for the ladle can be issued to each batch of the alloyed metal that has a great effect on the properties of the molten metal and that has been put into the ladle. Further, the information on the molten metal in the ladle for pouring is linked with the serial number for the ladle. When the ladle for pouring is transferred to the pouring machine, the serial number for the ladle is sent to the controller for the unit for pouring the molten metal. Thus the serial number for the ladle that is known by the controller for the unit for pouring the molten metal definitely corresponds to the information on the molten metal.

Regarding the casting plant of the fourth aspect of the invention, as shown in FIGS. 1 and 7, in the casting plant 1 of any of the first, second, and third aspects the unit 30 for conveying the molds also has a device 40-47 for treating a mold to finish the mold M. The controller 31 for the unit for conveying the molds controls the treatment to finish the mold M and gathers data on the treatment to link the data with the serial number for the mold. By this configuration, since the mold is finished so that it can receive the molten metal while it is being conveyed, the operating efficiency of the casting plant increases. Further, since the data on the treatment for finishing a mold can be linked with the serial number for the mold, the data regarding a mold can be collectively managed.

Regarding the casting plant of the fifth aspect of the invention, as shown in FIG. 1, in the casting plant 1 of any of the first, second, and third aspects the molding unit 10 has a machine 12 for measuring sand properties to measure the molding sand that is to be supplied to the molding machine 14. The controller 11 for the molding unit links information on the sand properties that have been measured by means of the machine 12 for measuring sand properties with the serial number for the mold. By this configuration, since the properties of the molding sand that is used for the mold are linked with the serial number for the mold, the data for molding the mold become more detailed. Further, the mold that has been molded by using the molding sand with the properties can be traced and managed.

Regarding the casting plant of the sixth aspect of the invention, as shown in FIG. 7, in the casting plant 1 of any of the first, second, and third aspects the data on the molding plan includes at least one of a reference number of a pattern, a weight of supplied sand, a time after applying a parting agent, a pressure for squeezing, a height of the mold, a thickness of the mold, and a rate of compression. By this configuration, a mold can be molded based on the data on the molding plan.

Regarding the casting plant of the seventh aspect of the invention, as shown in FIG. 7, in the casting plant 1 of any of the first, second, and third aspects the data on the pouring plan include at least one of a pouring weight, a period of time for pouring e, a material for pouring, a pouring pattern, a position of a pouring cup, a height of the mold, and an allowable period of time to fade. By this configuration, molten metal can be poured into a mold based on the data on the pouring plan.

Regarding the casting plant of the eighth aspect of the invention, as shown in FIGS. 6 and 7, in the casting plant 1 of any of the first, second, and third aspects the pouring machine 72 has a unit 76 for collecting a test piece that collects a test piece for each of the ladles for pouring. The controller 71 for the unit for pouring the molten metal issues a serial number for a test piece to the test piece that is collected by the unit 76 for collecting a test piece and links the serial number for the ladle with the serial number for the test piece. By this configuration, a test piece is collected from the molten metal in the ladle for pouring so that the serial number for the ladle is linked with the test piece through the serial number for the test piece.

Regarding the casting plant of the ninth aspect of the invention, as shown in FIG. 10, in the casting plant 1 of the eighth aspect a signal that indicates that the material is of poor quality is linked with the serial number for the test piece that has a poor result in a test to identify the serial number for the ladle, which serial number is linked with the serial number for the test piece that is linked with the signal so as to identify the serial number for the mold, which serial number is linked with the serial number for the ladle, so that the mechanism for conveyance handles the mold that corresponds to the identified serial number for the mold in a way that is different from other molds. By this configuration, a cast product that is cast by using molten metal that is of poor quality can be definitely removed.

Regarding the casting plant of the tenth aspect of the invention, as shown in FIG. 13, in the casting plant 2 of the third aspect the bogie 84 for transporting the ladle for pouring has a mechanism 848 for moving a ladle up and down, which mechanism moves the ladle L2 for pouring up and down. By this configuration, if the level for receiving molten metal from the furnace differs from that for pouring the molten metal into a mold, the levels can be easily matched so that a casting plant can be conveniently managed.

Regarding the casting plant of the eleventh aspect of the invention, as shown in FIGS. 4 and 6, in the casting plant 2 of the second or third aspect the unit 50 for transporting the molten metal has a first weighing scale 525 that weighs molten metal that has been received from the furnace F. The unit 70 for pouring the molten metal has a second weighing scale 725 that weighs molten metal in the ladle L2 for pouring, which ladle has been transferred from the unit 50 for transporting the molten metal. The controller 71 for the unit for pouring the molten metal sends an error signal if a difference between a weight that is measured by the first weighing scale 525 and a weight that is measured by the second weighing scale 725 exceeds an allowable difference in weights, both weights for a ladle that corresponds to a common serial number for the ladle. By this configuration, a quantity of the molten metal that has been lost by spilling or leaking during transportation is found so that an error signal is sent when the lost amount exceeds an allowance. Thus it is checked if the molten metal is safely and definitely transported.

Regarding the casting plant of the twelfth aspect of the invention, as shown in FIGS. 4 and 7, in the casting plant 2 of the second aspect the alloyed metal includes magnesium. The unit 50 for transporting the molten metal has a first weighing scale 525 that weighs molten metal that has been received from the furnace F. The controller 51 for the unit for transporting the molten metal detects a start of fading based on the changes of the weight that are measured by means of the first weighing scale 525, to send a fading-started signal that informs the controller 71 for the unit for pouring the molten metal of the start of fading or a signal that a period of time to fade has passed, which period of time is a period of time after the start of fading. The controller 71 for the unit for pouring the molten metal sends an error signal when a period of time after the start of fading, which period of time is obtained based on the fading-started signal or the signal that the period of time to fade has passed, exceeds the allowable period of time to fade and when pouring molten metal into a mold from the ladle L2 for pouring, which ladle corresponds to the serial number for the ladle that is the same as that for the fading-started signal or the signal that the period of time to fade has passed. By this configuration, since the start of fading is automatically detected, no operator must be nearby to watch the ladle for reacting. Thus operators are safe. Further, since it can be checked based on a correct period of time to fade, if the time during which poor spheroidizing may occur has not yet elapsed then poor spheroidizing caused by fading can be avoided.

Regarding the casting plant of the thirteenth aspect of the invention, as shown in FIG. 7, in the casting plant 1 of the fourth aspect the data for molding the mold include at least one of a reference number of a pattern, a time after applying a parting agent, a static pressure during molding, a pressure for squeezing, a quantity of supplied molding sand, a height of the mold, a thickness of the mold, a rate of compression, information on an air vent, information on a sprue, and information on a core. By this configuration, properties of a mold can be determined based on the data for molding the mold.

Regarding the casting plant of the fourteenth aspect of the invention, as shown in FIG. 7, in the casting plant 1 of the second or third aspect the data on the conditions of the molten metal include at least one of a material of the molten metal, a tapping time, a reference number of the furnace, a reference number of tapping from the furnace, a weight of received molten metal, a temperature of received molten metal, a period of time to fade, and the data on the alloyed metal. By this configuration, properties of the molten metal can be determined based on the data on the conditions of the molten metal.

Regarding the casting plant of the fifteenth aspect of the invention, as shown in FIG. 9, in the casting plant 1 of the second or third aspect the position of the ladle includes at least one of the position P1 for putting the alloyed metal, the position P2 for receiving the molten metal, the position P4 for transferring the molten metal between the ladles, and the position P5 for transferring the ladle. By this configuration, the position of the ladle is found and thereby the serial number for the ladle for pouring, which ladle has been transferred to the pouring machine, is correctly known.

Regarding the casting plant of the sixteenth aspect of the invention, as shown in FIG. 7, in the casting plant 1, 2 of the second or third aspect the controller 71 for the unit for pouring the molten metal sends an error signal when the material of the molten metal that is determined based on data on a plan for the molten metal, which data correspond to the serial number for the mold, differs from the material of the molten metal that is determined based on the data on the conditions of the molten metal, which molten metal is linked with the serial number for the ladle. By this configuration a cast product that is cast from molten metal that differs from the plan can be detected, to be definitely removed.

Regarding the casting plant of the seventeenth aspect of the invention, as shown in FIGS. 1 and 7 in the casting plant 1, 2 of any of the first to third aspect the molding unit 10 or the unit 30 for conveying the molds has a device 16 for engraving that engraves a surface of each cavity of the mold M. When the device 16 for engraving engraves the cavity, the controller 11 for the molding unit or the controller 31 for the unit for conveying the molds issues a serial number for an individual piece to every cavity in the mold, which cavity is engraved, to link the serial number for an individual piece with the serial number for the mold. By this configuration, since the device for engraving engraves a surface of each cavity of the mold, each cast product is engraved. Since a serial number for an individual piece is issued to each cavity of the molt, i.e., each cast product, each of the cast products can be easily managed. Further, since the serial number for the individual piece for each cast product is linked with the serial number for the mold, the data for molding the mold and the data on the conditions of the molten metal are integrally managed for each cast product.

To solve the above-mentioned problems, as shown in FIGS. 1, 2, and 3, the eighteenth aspect of the present invention is a method for managing data for molding a mold and data on conditions of molten metal in a casting plant 1 that molds a mold M, that conveys the mold M to a position PG for pouring molten metal, and that pours the molten metal from a ladle L2 for pouring located on the pouring machine 72 into the mold M, to obtain a cast product, comprises a step of issuing a serial number for a mold to each mold M. It also comprises a step of causing the serial number for the mold to correspond with a position of the mold M to which the serial number for the mold has been issued. It also comprises a step of linking the serial number for the mold with data on a molding plan for the mold M. It also comprises a step of shifting the serial number for the mold at the position of the mold M that is conveyed when conveyance of the mold M by a distance to the next mold is detected. It also comprises a step of finding a serial number for a ladle that is assigned to the ladle L2 for pouring located on the pouring machine 72, which serial number for a ladle is linked with the data on the conditions of the molten metal, which data show data on characteristics for recording the molten metal in the ladle L2 for pouring. It also comprises a step of linking the serial number for the ladle of the ladle L2 for pouring with the serial number for the mold M when the molten metal is poured from the ladle L2 for pouring into the mold M.

By this configuration, information on a mold is known by linking the information with a serial number for the mold that is issued to the mold and by shifting the serial number for the mold at the position of the mold that is conveyed each time the mold is conveyed. Information on the molten metal is linked with the serial number for the ladle that is issued to each ladle. Even when the mold is being conveyed or the ladle is being transported, the position of the mold or the ladle can be known. When the molten metal is poured into the mold by the pouring machine, the serial number for the mold, which mold is at the pouring machine, is linked with the serial number for the ladle so that, the data for molding the mold and the data on the conditions of the molten metal are integrally managed.

The method for managing the data of the nineteenth aspect of the invention, as shown in FIGS. 1, 2, and 7 in the method for managing the data of the eighteenth aspect further comprises a step of issuing a serial number for a ladle to a ladle L1 for reacting when an alloyed metal is put in the ladle L1 for reacting. It also comprises a step of causing the serial number for the ladle to correspond with a position of the ladle L1 for reacting to which the serial number for the ladle has been issued. It also comprises a step of linking data on conditions of the molten metal in the ladle L1 for reacting with the serial number for the ladle. It also comprises a step of shifting the serial number for the ladle at a position where the ladle L1 for reacting is transported when the ladle L1 for reacting is transported. It also comprises a step of linking the serial number for the ladle with the ladle L2 for pouring when the molten metal in the ladle L1 for reacting is transferred to the ladle L2 for pouring. It also comprises a step of shifting the serial number for the ladle at a position where the ladle L2 for pouring is transported when the ladle L2 for pouring is transported.

By this configuration, the serial number for the ladle is issued to each batch of the alloyed metal that has a significant effect on the properties of the molten metal. The data on the molten metal in the ladle are linked with the serial number for the ladle. When the ladle for pouring is transported, the serial number for the ladle is shifted. Thus the serial number for the ladle definitely corresponds with the information on the molten metal.

The method for managing the data of the twentieth aspect of the invention, as shown in FIGS. 7, 11, and 12 in the method for managing the data of the eighteenth aspect further comprises a step of issuing a serial number for the ladle to the ladle L2 for pouring when the alloyed metal is put into the ladle L2 for pouring. It also comprises a step of causing the serial number for the ladle to correspond with a position of the ladle L2 for pouring to which the serial number for the ladle has been issued. It also comprises a step of linking data on conditions of the molten metal in the ladle L2 for pouring with the serial number for the ladle. It also comprises a step of shifting the serial number for the ladle at a position where the ladle L2 for pouring is transported when the ladle L2 for pouring is transported.

By this configuration, a serial number for a ladle is issued to each batch of the alloyed metal that has been put, which alloyed metal has a significant effect on properties of the molten metal. Information on the molten metal in the ladle is linked with the serial number for the ladle. When the ladle for pouring is transported, the serial number for the ladle is shifted. Thus the serial number for the ladle definitely corresponds with the information on the molten metal.

By the casting plant or the method for managing the data for molding the mold and the data on the conditions of the molten metal of the present invention, even when the mold is being conveyed or the ladle is being transported, the position of the mold or the ladle can be known. Since the data for molding the mold and the data on the conditions of the molten metal are integrally managed at a later stage, reliability of a cast product increases while meeting the requirements for a high rate of production and a high-mix low-volume production The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

MODE FOR CARRYING OUT THE INVENTION

Figure 1:
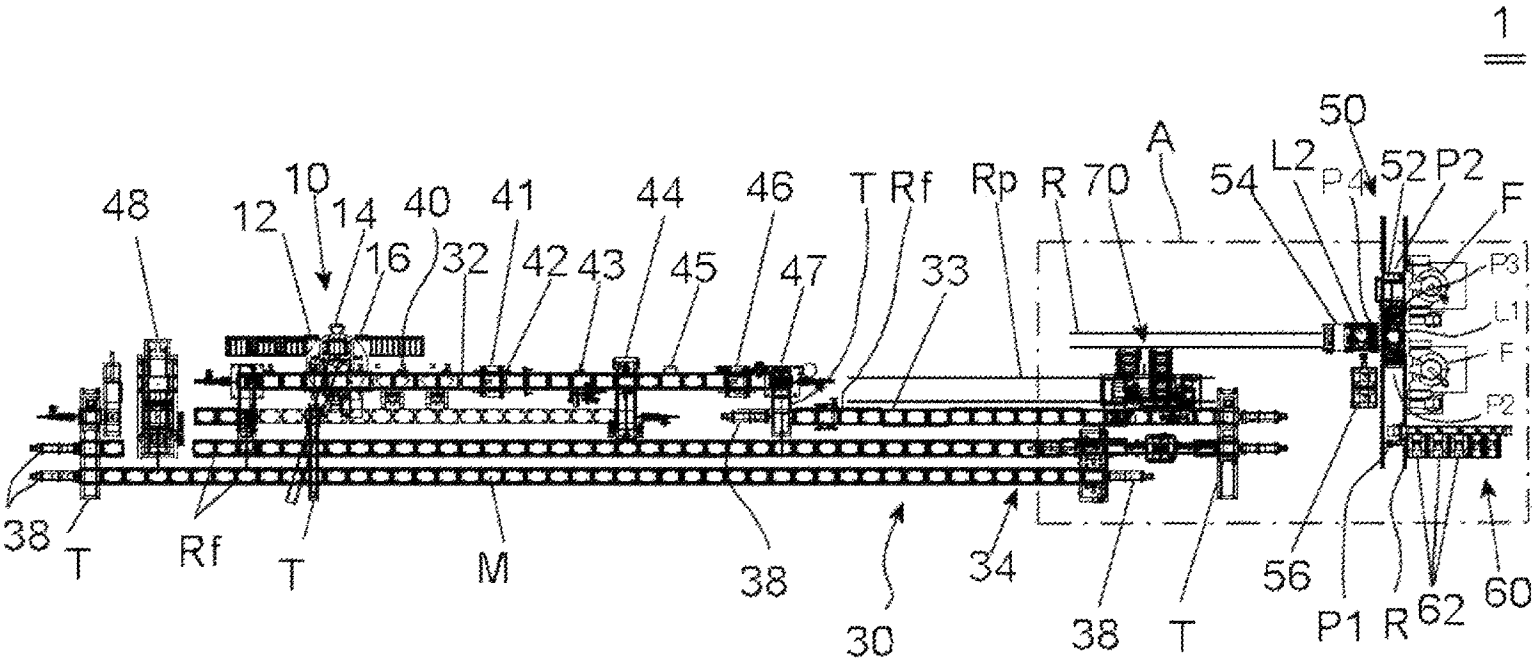
FIG. 1 is a plan view illustrating the configuration of the casting plant. It shows the casting plant in which molten metal is received from the furnace by a ladle for reacting, is transferred to a ladle for pouring, and is poured from the ladle for pouring into a mold.

Below, an embodiment of the present invention is discussed with reference to the appended drawings. In the drawings, the same numeral or symbol is used for the elements that correspond to, or are similar to, each other. Thus duplicate descriptions are omitted.

Figure 2:
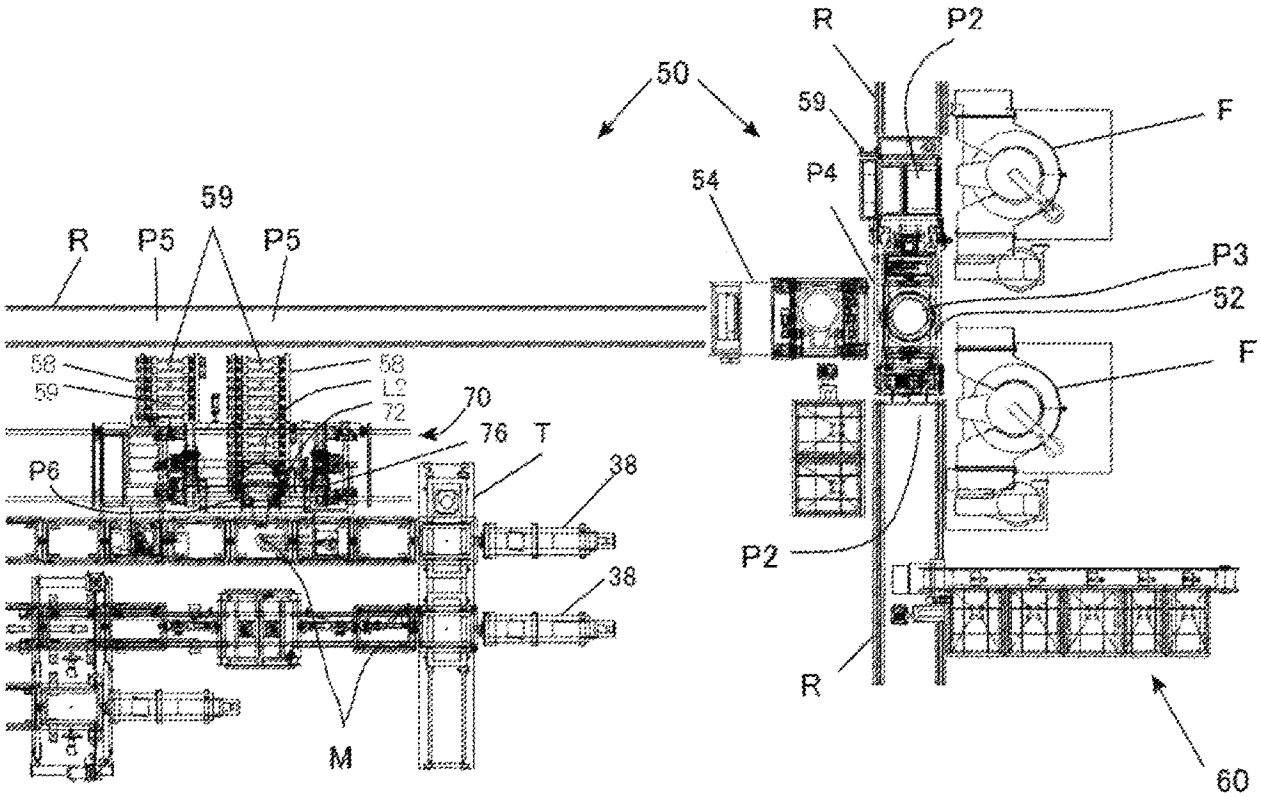
FIG. 2 is an enlarged view of part A in FIG. 1.

With reference to FIGS. 1 and 2, the structure of a casting plant 1 is now discussed. FIG. 1 is a plan view of the structure of the casting plant and FIG. 2 is an enlarged view of Part A in FIG. 1. The casting plant 1 comprises a molding unit 10, a unit 30 for conveying molds, a unit 50 for transporting molten metal, and a unit 70 for pouring the molten metal. The molding unit 10 molds a mold M by using molding sand. The unit 30 for conveying the mold conveys the mold M that has just been molded from the molding unit 10 to the unit 70 for pouring the molten metal. Then it conveys the mold M into which the molten metal has been poured by the unit 70 for pouring the molten metal. Thus the molten metal is cooled and solidified to be a cast product.

The cast product is taken out of the mold by a shake-out machine 48. By the unit 50 for transporting the molten metal an alloyed metal is put into a ladle L1 for reacting. The lade L1 for reacting receives molten metal from a furnace F. The molten metal reacts with the alloyed metal. The molten metal after the reaction is transferred to the ladle L2 for pouring. The ladle L2 for pouring is transferred to the pouring machine 72 of the unit 70 for pouring the molten metal. The unit 70 for pouring the molten metal pours the molten metal from the ladle L2 for pouring into the mold M.

The molding unit 10 has a device 12 for measuring the properties of molding sand before molding. The molding sand before molding is a mulled sand prepared by mulling the sand with a binder, an additive, a hardening agent, and water, wherein the sand is, for example, green sand or is processed by means of a device for recovering molding sand by using the sand that has been exhausted from the shake-out machine 48. Since the properties of the molding sand significantly affect the properties of a cast product, they are measured before molding.

The molding unit 10 has a molding machine 14 that molds a mold by using the molding sand. By the molding machine 14 the molding sand is packed around a pattern that copies the shape of a cast product to mold a cope and a drag for one cast product. There are two types of molds. One is a tight flask mold wherein a mold is molded within a flask, and the other is a flaskless mold wherein a mold is molded without a flask. The molding machine 14 has instruments (not shown) that measure the data on the characteristics for recording the molding, such as the weight of the supplied sand, the rate of compression, the static pressure or the pressure for squeezing, the period of time for squeezing, the rate for pressurizing, the stroke for squeezing, the thickness of the mold, and a time for molding, and the time of the molding.

The molding unit 10 may have a device 16 for engraving that engraves an inner surface of a space in a mold to identify the space. The space is formed by a pattern and is used for filling molten metal to solidify it there, to obtain a cast product. The device 16 for engraving may drill a plurality of holes on the surface of the space by means of a drill by changing the relative positions of the holes. Alternatively, it may form holes or grooves by means of a laser. When holes are formed on the inner surface of each space of a mold, projections that correspond to the holes are formed on the surface of a cast product so that each cast product can be identified. Here, the words "each space" are used, since a plurality of cast products can be molded by one mold. That is, one mold may have a plurality of spaces. Since the inner surface of each space of a mold is engraved, each cast product has an engraved mark. Incidentally, the device 16 for engraving may be provided in the unit 30 for conveying the molds. However, engraving just after molding a mold is easier, since a self-hardening mold, for example, can be engraved before it thoroughly hardens and therefore does not break. Especially, when a flaskless mold is used, the device 16 for engraving engraves the mold that is located in the molding machine 14.

The unit 30 for conveying the molds has a rail Rf for molds by which molds are conveyed from the molding unit 10 to the unit 70 for pouring the molten metal and are conveyed to the shake-out machine 48 while they are cooled. The rail Rf for molds has lines that are parallel, for example, as shown inn. FIG. 1. The molds are transferred between the lines of the rail RF and conveyed in reverse directions in alternate lines of the rail Rf. Thus the molds M into which the molten metal has been poured are cooled over time. The molten metal solidifies to become a cast product before the mold is conveyed to the shake-out machine 48. Namely, the route for conveying of the unit 30 for conveying the molds is generally divided into the line 32 for molding, a zone 33 for pouring the molten metal into the unit for conveying the molds, and a zone 34 for cooling in the unit for conveying the molds. On the line 32 for molding, a mold that is molded by the molding machine 14 is processed to be a complete mold into which the molten metal can be poured. The zone 33 for pouring the molten metal in the unit for conveying the molds is a line for the mold into which the molten metal is poured. By the zone 34 for cooling in the unit for conveying the molds the mold M into which the molten metal has been poured is conveyed over a long period of time, to be cooled.

Figure 3:
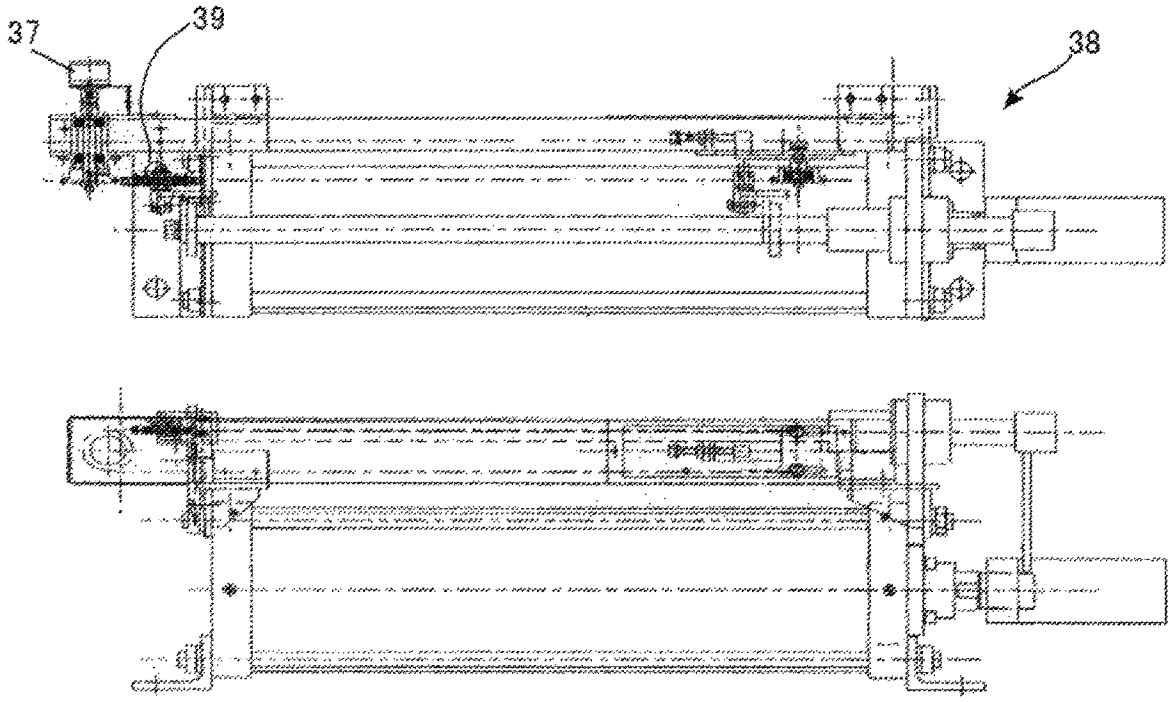
FIG. 3 illustrates a pusher for molds and a sensor that detects the operation of the pusher.

The unit 30 for conveying the molds has pushers 38 for the molds at the ends of the lines of the rail Rf. Each pusher 38 for the molds is a mechanism for conveyance as in FIG. 3. The pusher 38 is a device in which a rod expands and contracts to push the molds, such as an air cylinder, an oil cylinder, or an electric cylinder. The pusher 38 has a sensor 39 for the position of the mold, which sensor detects the expansion and contraction of the rod and detects the conveyance of the mold M. The sensor 39 for the position of the mold may be a limit switch, a proximity switch, an opto-electronic switch, or the like. The pusher 38 preferably has an encoder 37 for detecting the position of the mold, to achieve synchronized pouring and to accurately detect the position to pour the molten metal when the thickness of the mold is changed. The pusher 38 pushes a mold by a distance to the next mold. It pushes the mold that is located at the back end of a line of molds on the rail Rf to intermittently convey the molds in the line by a distance to the next mold. Another pusher 38 is preferably provided at the opposite end (front end) of the line of the rail Rf so that the rod contracts at the same time that the molds are pushed at the back end. By this configuration the line of the molds can be restrained from both ends during conveyance, to thereby stabilize the molds. When the mold M reaches the front end, it is transferred to the next rail Rf by means of a traverser T to be located at the back end of the line. A sensor 39 for the position of the mold may be also provided to the traverser T.

The line 32 for molding of the unit 30 for conveying the molds also has a device 40 for drilling a gas vent to drill a vent to let out gas that is generated when the molten metal is poured. The line 32 for molding also has a device 41 for rolling over the cope and drag. For example, a cope and a drag are turned over to turn the spaces of the molds upward. The line 32 for molding also has a remover 42 for surplus sand to remove surplus sand on the upper surface of the cope and the lower surface of the drag, to flatten the surfaces. The line 32 for molding also has a cutter 43 for a sprue to form a sprue in the cope.

The line 32 for molding also has a device 44 for setting a molding board to set a mold on the molding board. The line 32 for molding also has a device 45 for setting a core to set cores on the cope and drag. The line 32 for molding also has a device 46 for rolling over the cope a second time to roll over the cope to direct it to match the drag when the cope and drag are assembled. The line 32 for molding also has a device 47 for assembling molds to assemble the cope and the drag to obtain a complete mold into which molten metal can be poured. Incidentally, the sequence of alignment from the device 40 for drilling a gas vent to the device 45 for setting a core is not limited to the one that is discussed above and any device may be replaced as appropriate.

When a tight flask mold is used, for example, as in FIG. 1, the unit 30 for conveying the molds comprises the device 40 for drilling a gas vent, the device 41 for rolling over the cope and drag, the remover 42 for surplus sand, the cutter 43 for a sprue, the device 44 for setting a molding board, the device 45 for setting a core, the device 46 for rolling over the cope a second time, and the device 47 for assembling the molds. Thereby, the mold M that has been molded by the molding machine 14 is processed to become a complete mold into which molten metal can be poured. When a flaskless mold is used, processing such as drilling a gas vent, setting a core, and assembling the molds may be conducted at the molding machine 14. In this case, the unit 30 for conveying the molds need not have some or any of the devices 40-47 for processing the mold.

The unit 30 for conveying the molds also has a shake-out machine 48. By the shake-out machine 48 the mold is broken to take out the cast product. The cast product and the sand are separated. The cast product is shipped after a post-process. The sand is used for molding after removing any iron particles, a binder, etc., by means of a device for recovering molding sand (not shown).

The unit 50 for transporting the molten metal has a unit 60 for feeding an alloyed metal, which unit puts it in the ladle L1 for reacting an alloyed metal that is to react with the molten metal. The unit 60 for feeding an alloyed metal has a plurality of hoppers 62 for an alloyed metal to put a kind of alloyed metal or kinds of alloyed metals in the ladle L1 for reacting. Alternatively, the ladle L1 for reacting may be covered by a cap in which an aperture is formed. A device for inoculating by a wire (not shown) passes a thin pipe, in which an alloyed metal is filled, through the aperture, to cause the alloyed metal to react with the molten metal. The unit 60 for feeding an alloyed metal has an instrument (not shown) for measuring the weight of the alloyed metal that has been put in the ladle L1 for reacting from the hoppers 62 for an alloyed metal. It also has a timer (not shown).

The unit 50 for transporting the molten metal has the bogie 52 for receiving molten metal that has a mechanism for transferring the molten metal and a rail R on which the bogie 52 travels. The bogie 52 for receiving molten metal that has a mechanism for transferring the molten metal transports the ladle L1 for reacting to the position P1 for putting the alloyed metal where the alloyed metal is put into the ladle L1 for reacting from the unit 60 for feeding an alloyed metal, to the position P2 for receiving the molten metal where the ladle L1 for reacting receives the molten metal from the furnace F, and to the position P4 for transferring the molten metal between the ladles where the molten metal is transferred to the ladle L2 for pouring. When the alloyed metal reacts with the molten metal by inoculating by a wire, the position where the alloyed metal is inoculated by a wire is the position P1 for putting the alloyed metal. In addition, the passage "when the alloyed metal is put" should be understood as meaning "when the alloyed metal is inoculated by a wire." Incidentally, the alloyed metal may be one of Mg, Ce, Ca, Ni, Cr, Cu, Mo, T, etc., which is added to the molten metal to enhance the strength, toughness, corrosion resistance, heat resistance, abrasion resistance, and so on, of cast iron. A graphite-spheroidizing element can be an alloyed metal. The unit 60 for feeding an alloyed metal may add an inoculant, such as SiCa, ferrosilicon, or graphite.

Figure 4:
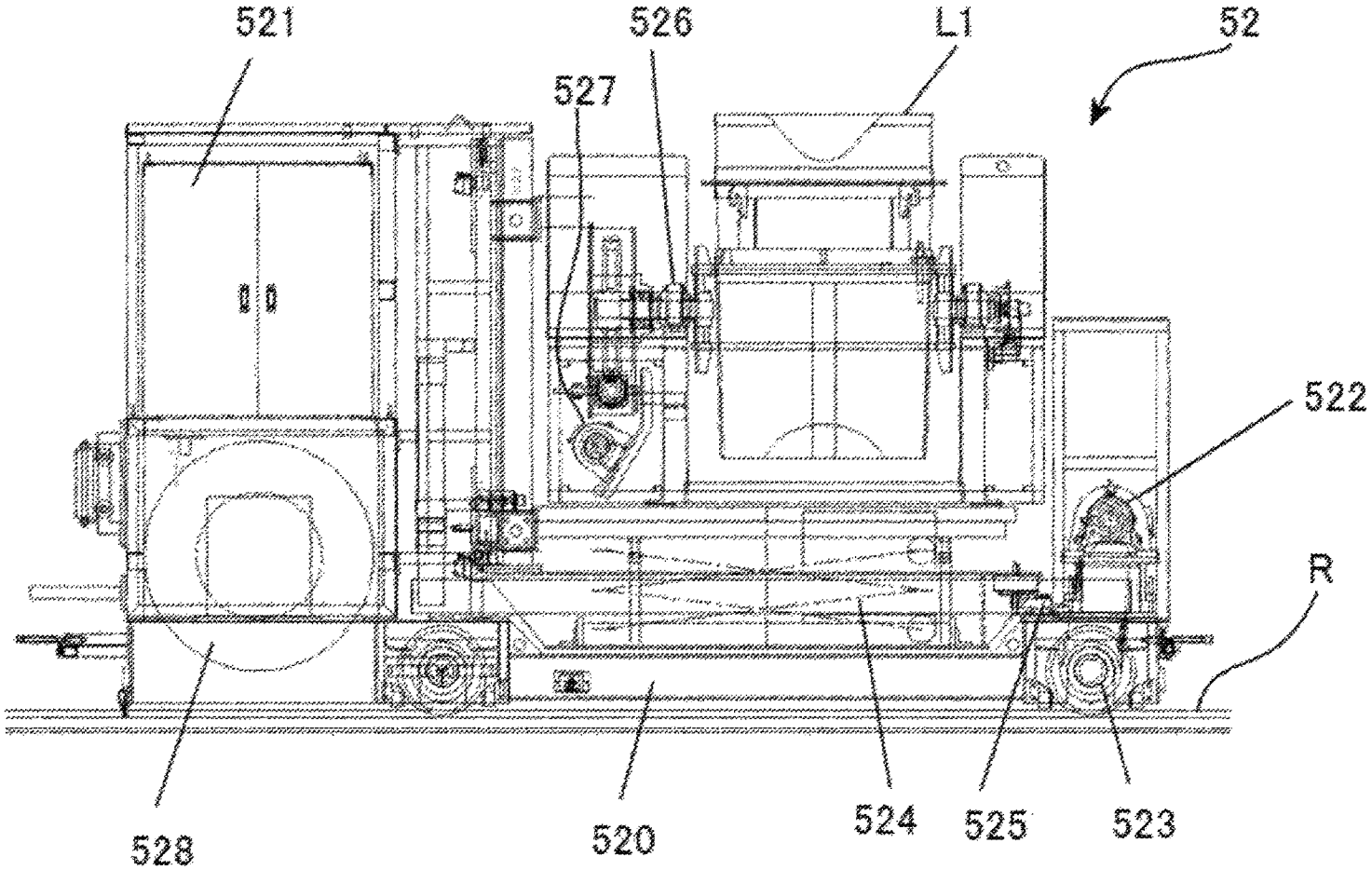
FIG. 4 is a side view of a bogie for receiving molten metal that has a mechanism for transferring.

As in FIG. 4, the bogie 52 for receiving molten metal that has a mechanism for transferring the molten metal has a travelling bogie 520 that travels on the rail R and a motor 522 for travelling that is used for causing the travelling bogie 520 to travel. One of the wheels of the travelling bogie 520 is equipped with an encoder 523 to measure the rotation of the wheel, namely the travel of the travelling bogie 520. That is, the encoder 523, which can detect the position of the ladle L1 for reacting, is a sensor for detecting the ladle. Incidentally, the bogie 52 for receiving molten metal that has a mechanism for transferring the molten metal may be equipped with a sensor 59 for detecting the ladle, such as an optoelectronic sensor, which is discussed below. The bogie 52 for receiving molten metal that has a mechanism for transferring the molten metal has a device 526 for tilting the ladle, which device tilts the ladle L1 for reacting so as to transfer the molten metal. It also has a motor 527 for tilting, which causes the device 526 for tilting the ladle to tilt the ladle L1 for reacting. The device 526 for tilting the ladle and the ladle L1 for reacting are mounted on a scissor lift 524, which is provided on the travelling bogie 520 so as to move them up and down. Since the bogie 52 for receiving molten metal that has a mechanism for transferring the molten metal can move the ladle L1 for reacting up and down, transferring the molten metal from the ladle L1 for reacting to the ladle L2 for pouring becomes easy. The bogie 52 for receiving molten metal that has a mechanism for transferring the molten metal has a load cell 525 (a first weighing scale) to weigh the molten metal that has been received from the furnace F. It also has a noncontact thermometer (not shown) that measures the temperature of the molten metal that has been received.

In the bogie 52 for receiving molten metal that has a mechanism for transferring the molten metal, a cable reel 528 that receives electricity from the outside and a control panel 521 are located apart from the ladle L1 for reacting. Thus, if molten metal were to leak from the ladle L1 for reacting, neither of these devices would be damaged from such an accident. Incidentally, the control panel 521 may be located not on the travelling bogie 520, but along the rail R on which the travelling bogie 520 travels.

When the molten metal is poured into the ladle L1 for reacting in which the alloyed metal has been put and when the alloyed metal and the molten metal react, droplets of the molten metal fly or dust or gas is generated. Thus, when the alloyed metal and the molten metal in the ladle L1 for reacting react, the ladle L1 for reacting is transported to the position P3 for reaction. A room for reaction (not shown) is preferably provided at the position P3 for reaction. There the area above the ladle L1 for reacting is surrounded and air is discharged by means of a duct. Thus the droplets of the molten metal are prevented from flying out and the dust, etc., can be discharged.

Figure 5:
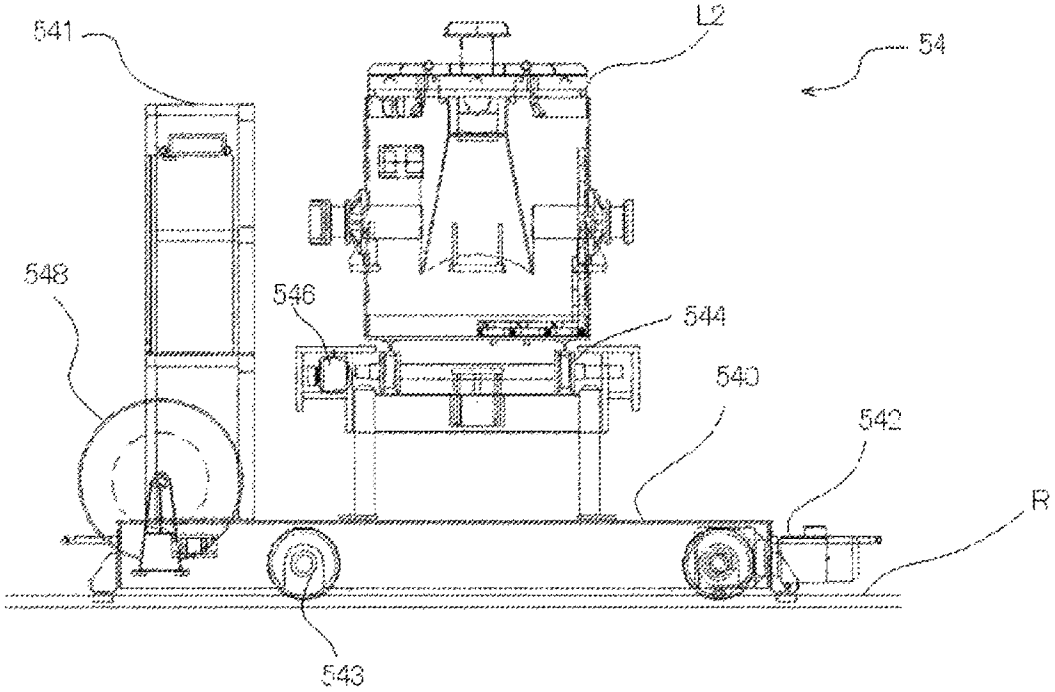
FIG. 5 is a side view of a bogie for transporting the ladle for pouring.

As in FIG. 5, the unit 50 for transporting the molten metal has a bogie 54 for transporting the ladle for pouring, which bogie transports the ladle L2 for pouring to the position P4 for transferring the molten metal between the ladles (precisely, this position P4 differs from the position P4 of the ladle L1 for reacting, but uses the same position, P4, for convenience) where the molten metal is transferred from the ladle L1 for reacting and to the position P5 for transferring the ladle where the ladle L2 for pouring is transferred to the pouring machine 72. It also has the rail R on which the bogie 54 for transporting the ladle for pouring travels. The bogie 54 for transporting the ladle for pouring has a travelling bogie 540 that travels on the rail, a roller conveyor 544 that is provided on the travelling bogie 540 and horizontally moves the ladle L2 for pouring, and a motor 546 for the roller conveyor. One of the wheels of the travelling bogie 540 is equipped with an encoder 543 to measure the rotation of the wheel, namely, the travel of the travelling bogie 540. That is, the encoder 543, which can detect the position of the ladle L2 for pouring, is a sensor for detecting the ladle. In the bogie 54 for transporting the ladle for pouring, a cable reel 548 that receives electricity from the outside and a control panel 541 are located apart from the ladle L2 for pouring. Thus, if molten metal were to leak from the ladle L2 for pouring, neither of these devices would be damaged from such an accident. Incidentally, instead of the control panel 541 being located on the travelling bogie 540, it may be located along the rail R on which the travelling bogie 540 travels. A mechanism 58 for transporting the ladle for pouring may be provided between the position P5 for transferring the ladle and the pouring machine 72, to convey the ladle L2 for pouring in a direction perpendicular to the direction the bogie 54 travels. The mechanism 58 for transporting the ladle for pouring may be a roller conveyor or the like. Incidentally, when the capacity of the ladle L1 for reacting is double that of the ladle L2 for pouring, the molten metal of one ladle L1 for reacting may be transferred to two ladles L2 for pouring.

A device 56 for inoculating while transferring the molten metal, which device adds an inoculant to the molten metal that is being transferred from the ladle L1 for reacting to the ladle L2 for pouring, may be provided near the position P4 for transferring the molten metal between the ladles. The configuration of the device 56 for inoculating while transferring the molten metal is generally the same as that of the unit 60 for feeding an alloyed metal. Since an inoculant is added to the molten metal while the molten metal is being transferred from the ladle L1 for reacting to the ladle L2 for pouring, the inoculant can be uniformly added within a short period.

The unit 50 for transporting the molten metal has sensors 59 for detecting the ladle. The sensors detect that the ladle L1 for reacting has been transferred to the position P1 for putting the alloyed metal, the position P2 for receiving the molten metal, the position P3 for reaction, or the position P4 for transferring the molten metal between the ladles. These positions are the positions of the ladle L1 for reacting. The sensors 59 for detecting the ladle also detect that the ladle L2 for pouring has been transported to the position P4 for transferring the molten metal between the ladles or to the position P5 for transferring the ladle. These positions are the positions of the ladle L2 for pouring. As in FIG. 2, the sensor 59 for detecting the ladle may be a proximity switch or a laser sensor that is provided under the roller conveyor of the mechanism 58 for transporting the ladle for pouring. Alternatively, it may be the encoder 523, 543 that is provided to the bogie 52 for receiving molten metal that has a mechanism for transferring the molten metal of FIG. 4 or the bogie 54 for transporting the ladle for pouring of FIG. 5. Alternatively, it may be an optoelectronic sensor that is provided to the bogie 52 for receiving molten metal that has a mechanism for transferring the molten metal or the bogie 54 for transporting the ladle for pouring. Incidentally, an optoelectronic sensor is preferably provided to detect that the ladle L1 for reacting is mounted on the bogie 52 for receiving molten metal that has a mechanism for transferring the molten metal and that the ladle L2 for pouring is mounted on the bogie 54 for transporting the ladle for pouring.

Figure 6:
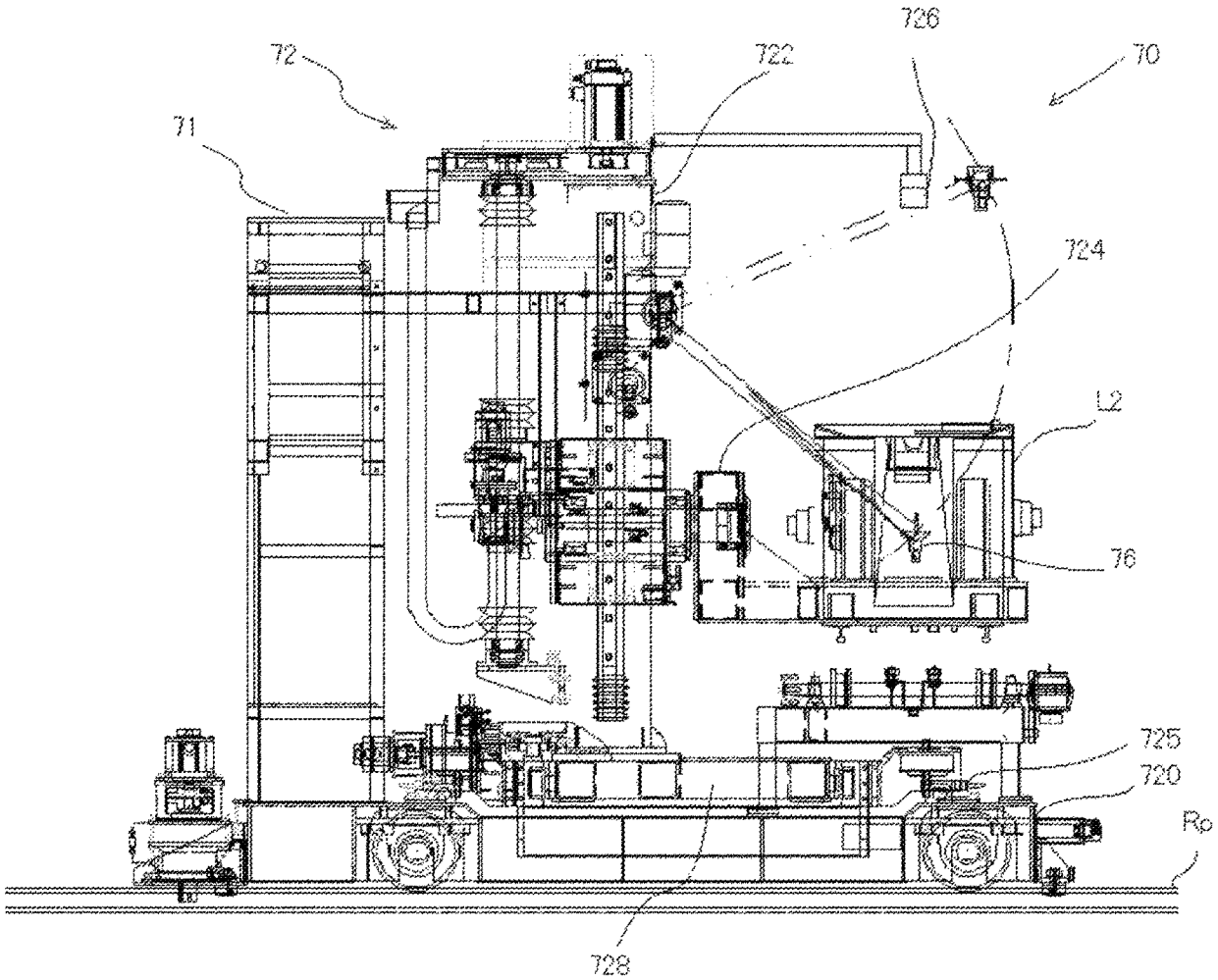
FIG. 6 is a side view of a pouring machine.

As in FIG. 6, the unit 70 for pouring the molten metal has a pouring machine 72 to pour the molten metal from the ladle L2 for pouring into a mold M. The pouring machine 72 has a bogie 720 for the pouring machine, which bogie travels in parallel to the mold M that is conveyed and into which mold M the molten metal is poured. It also has a mechanism 722 for vertically moving the ladle that is mounted on the bogie 720 for the pouring machine. It also has a mechanism 724 for tilting the ladle, which mechanism is supported by the mechanism 722 for vertically moving the ladle and which mechanism tilts the ladle L2 for pouring. It also has a rail. Rp for the pouring machine on which the bogie 720 for the pouring machine travels. It also has a load cell 725 (a second weighing scale) that weighs the molten metal in the ladle L2 for pouring. The mechanism 722 for vertically moving the ladle is mounted on a mechanism 728 for moving the ladle back and forth, which mechanism moves in the direction perpendicular to the direction the bogie 720 for the pouring machine travels. The unit 70 for pouring the molten metal has also a noncontact thermometer (not shown) to measure the temperature of the molten metal to be poured into the mold. The noncontact thermometer is preferably a fiber-type, so as to enable the part to be adjusted that is to measure the temperature.

The pouring machine 72 preferably has a camera 726 for detecting the surface of the molten metal to detect the level of the surface of the molten metal at the sprue of the mold M. In this case, by tapering the pouring cup of the sprue the level of the surface of the molten metal can be detected based on the area of the surface of the molten metal that has been shot by the camera 726. The camera 726 for detecting the surface of the molten metal may be an image sensor. It is preferably supported (suspended) by an arm to horizontally move so as to take an image of the surface of the molten metal when the position of the sprue changes.

As in FIG. 6, the unit 70 for pouring the molten metal preferably has a unit 76 for collecting a test piece (TP), which unit receives the molten metal from the ladle L2 for pouring to prepare a test piece (TP). The unit 76 for collecting a test piece collects a test piece from each ladle L2 for pouring to test the material.

Figure 7:
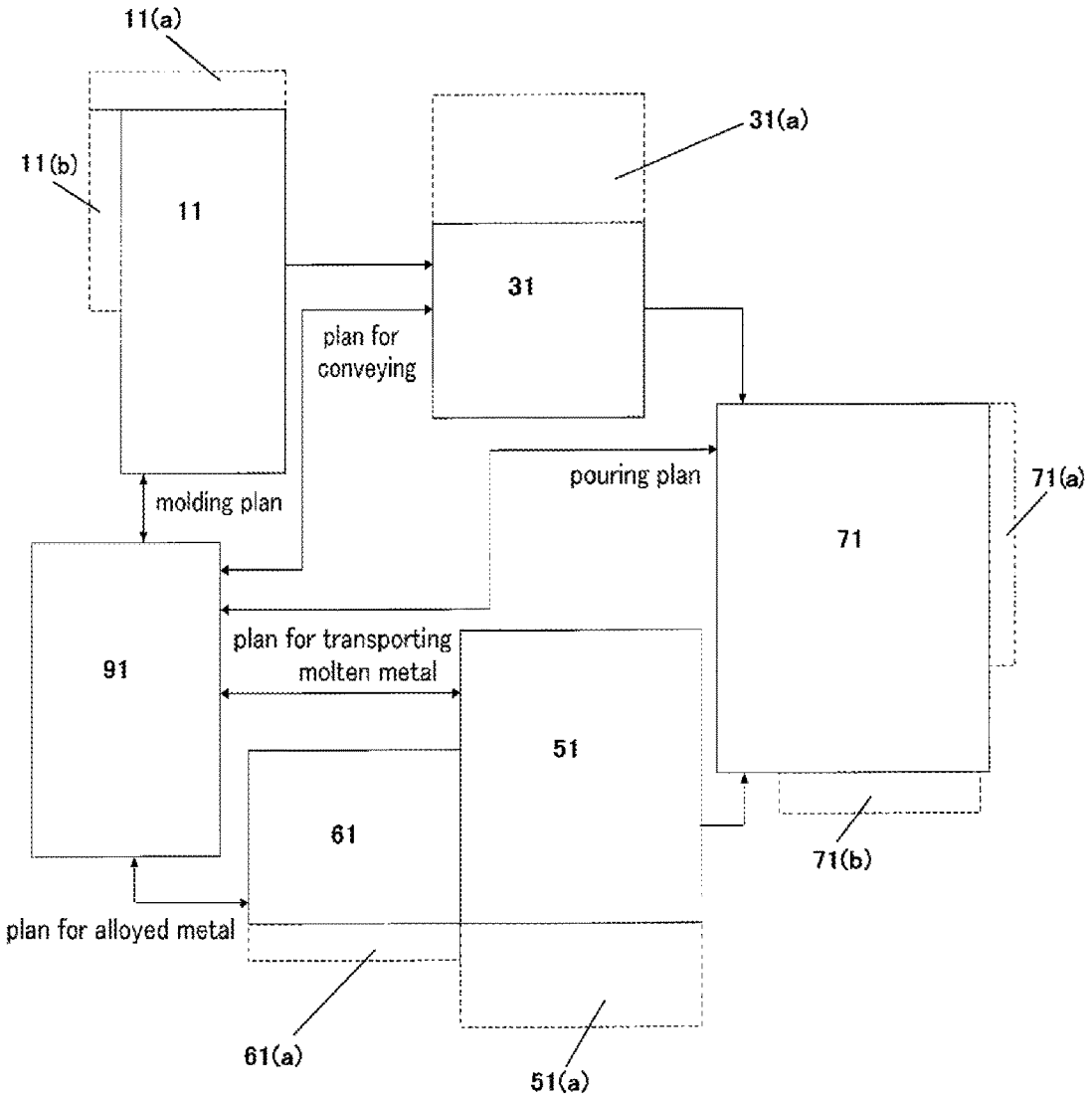
FIG. 7 is a block diagram showing the data that are obtained by each unit and showing data communication between the units.

As in FIG. 7, the casting plant 1 comprises a computer 91 for controlling the casting plant to control the entire casting plant 1. It also comprises controllers for the respective units. Namely, it comprises a controller 11 for the molding unit 10, a controller 31 for the unit 30 for conveying the molds, the controller 51 for the unit 50 for transporting the molten metal, and a controller 71 for the unit 70 for pouring the molten metal. Further, it comprises a controller 61 for the unit 60 for feeding an alloyed metal. It may comprise a controller for the unit 76 for collecting a test piece. These controllers are provided to the respective units, but may be located at any place. For example, the controller 51 for the unit for transporting the molten metal may consist of the control panel 521 of the bogie 52 for receiving molten metal that has a mechanism for transferring the molten metal and the control panel 541 of the bogie 54 for transporting the ladle for pouring. The controller 71 for the unit for pouring the molten metal may be located on the bogie 720 for the pouring machine as in FIG. 6, or may be located along the rail for the pouring machine. Incidentally, multiple controllers 11, 31, 51, 61, 71 may be physically located within a common controller or within the computer 91 for controlling the casting plant. The computer 91 for controlling the casting plant may be any computer that manages data. Its configuration is not particularly limited. Alternatively, by using cloud computing the operations of the respective controllers and the computer 91 for controlling the casting plant may be conducted by a computer that is located at a place that is apart from the casting plant 1. In these cases, the units have the respective controllers and the casting plant 1 comprises the computer 91 for controlling the casting plant.

Next, with reference to FIGS. 1, 2, and 7, a process for casting by the casting plant 1 and a method for managing the data are discussed. Based on a plan for production, an input by a user, etc., the following data are input in, or calculated by, the computer 91 for controlling the casting plant:

data on the molding plan that show a plan to mold the mold. M by the molding unit 10, data on the conveying plan that show a plan to convey the mold M that has been molded by the unit 30 for conveying the molds and a plan to process the mold M, such as to drill an air vent, data on the transporting plan of the molten metal that show a plan to transport and transfer the molten metal by the unit 50 for transporting the molten metal, data on the plan for the alloyed metal that show a plan to put the alloyed metal and to inoculate by the unit 60 for feeding an alloyed metal, and data on the pouring plan that show a plan to pour the molten metal from the ladle L2 for pouring into the mold M by the unit 70 for pouring the molten metal. Incidentally, any of the data on the molding plan, the data on the conveying plan, the data on the transporting plan of the molten metal, the data on the plan for the alloyed metal, and the data on the pouring plan, may be combined to be treated as a set of data. A combination of the data on the transporting plan of the molten metal and the data on the plan for the alloyed metal is called the data on a plan for the molten metal.

The data on the molding plan may include the reference number of a pattern, the period of time after applying a parting agent, the static pressure or the pressure for squeezing during molding, the quantity of supplied molding sand, the height of the mold, the thickness of the mold, the rate of compression, and so on. The data on the conveying plan may include the air vent, the shape and the position of the sprue, the core setting, the time for one cycle for intermittently conveying the molds, and so on. The data on the transporting plan of the molten metal may include the reference number of the material, the planned weight of received molten metal, and so on. The data on the plan for the alloyed metal may include the reference number of the hopper, the weight of the alloyed metal to be taken from the hopper, and so on. The data on the pouring plan may include the weight of the molten metal to be poured, the position of a pouring cup, the allowable temperature for pouring, the allowable period of time to fade, the material of the molten metal that fits the mold, and so on.

The molding unit 10 molds the mold M based on the data on the molding plan. First, the properties of the molding sand before molding are measured by a device 12 for measuring properties of molding sand before molding. The properties to be measured may include compactability (CB), moisture, the temperature of the sand, permeability, the strength of a mold (compressive strength), and so on. The properties of the molding sand significantly affect the quality of a mold. The measured properties of the molding sand are recorded by the controller 11 for the molding unit as data on the characteristics for recording the molding.

A mold (a cope and a drag) is molded by means of the molding machine 14 from the molding sand of which the properties have been measured. A parting agent is applied to a pattern. A predetermined quantity of the molding sand is packed. The molding sand is pressurized by a static pressure or a pressure for squeezing to be at a predetermined rate of compression. Thus a mold that has a set thickness and a set height is molded. When the mold is molded the controller 11 for the molding unit issues a serial number for the mold to that mold. When the serial number for the mold is issued, the data on the molding plan, such as the properties that have been measured of the molding sand, are linked with the serial number for the mold. Further, the data on the characteristics for recording the molding, such as the weight of supplied sand, the rate of compression, the static pressure or the pressure for squeezing, the period of time for squeezing, the rate of pressurizing, the stroke for squeezing, the thickness of the mold, and the time of the molding, are measured by the molding machine 14. They are linked with the serial number for the mold as the data on the characteristics for recording the molding. The controller 11 for the molding unit sends the serial number for the mold and the data on the characteristics for recording the molding to the computer 91 for controlling the casting plant. The data on the molding plan and the data on the characteristics for recording the molding are collectively called data for molding the mold. The controller 11 for the molding unit sends the serial number for the mold and the data for molding the mold that is linked with the serial number for the mold to the controller 31 for the unit for conveying the molds.

When a mold is molded by the molding machine 14, a mark is engraved by means of the device 16 for engraving on the inner face of a space of the mold, which space is used for producing a cast product, so that the space can be identified. Either the cope or the drag is engraved. When one mold has multiple spaces, namely, multiple cast products are produced by using one mold, a unique mark is engraved on each space. That is, each cast product is marked with a unique mark. When the device 16 for engraving engraves the space, the controller 11 for the molding unit issues a serial number for the individual piece for each engraved space. The controller 11 for the molding unit links the serial number for the individual piece that has been issued with the serial number for the mold. Incidentally, when the device 16 for engraving is positioned in the unit 30 for conveying the molds, the serial number for the individual piece may be issued by the controller 31 for the unit for conveying the molds and linked with the serial number for the mold by the controller 31 for the unit for conveying the molds.

The unit 30 for conveying the molds transports the mold M based on the data on the plan for conveying the mold, makes the mold M ready for being poured, cools the poured mold, namely, the molten metal, and separates the cast product from the sand. By the unit 30 for conveying the molds, they are intermittently conveyed by a distance to the next mold by means of the pusher 38. The traverser T also transfers the molds one by one to the next line of molds. The device 40 for drilling a gas vent forms a gas vent in the mold. The device 41 for rolling over the cope and drag rolls over the cope and the drag to cause the spaces of the molds to face upward. The remover 42 for surplus sand removes surplus sand on the upper surface of the cope. The cutter 43 for a sprue forms a sprue in the cope. The device 44 for setting a molding board sets the mold on the molding board. The device 45 for setting a core sets cores on the cope and drag. The device 46 for rolling over the cope a second time rolls over the cope. The device 47 for assembling the molds assembles the cope and the drag to form a mold M. The data on the characteristics for recording during these processes, such as information on an air vent, information on a sprue, and information on a core, are collected as data for molding the mold (the data on the characteristics for recording the molding). They are linked with the serial number for the mold. In this way, the unit 30 for conveying the molds collects the data for molding the mold while conveying the mold. If trouble occurs in these process, the controller 31 for the unit for conveying the molds links the information on the trouble with the serial number for the mold of the mold M. Incidentally, when a flaskless mold is used, some or all of the information on an air vent, the information on a sprue, the information on a core, and so on, may be obtained by the molding unit 10. They may be linked with the serial number for the mold by means of the controller 11 for the molding unit.

Figure 8:
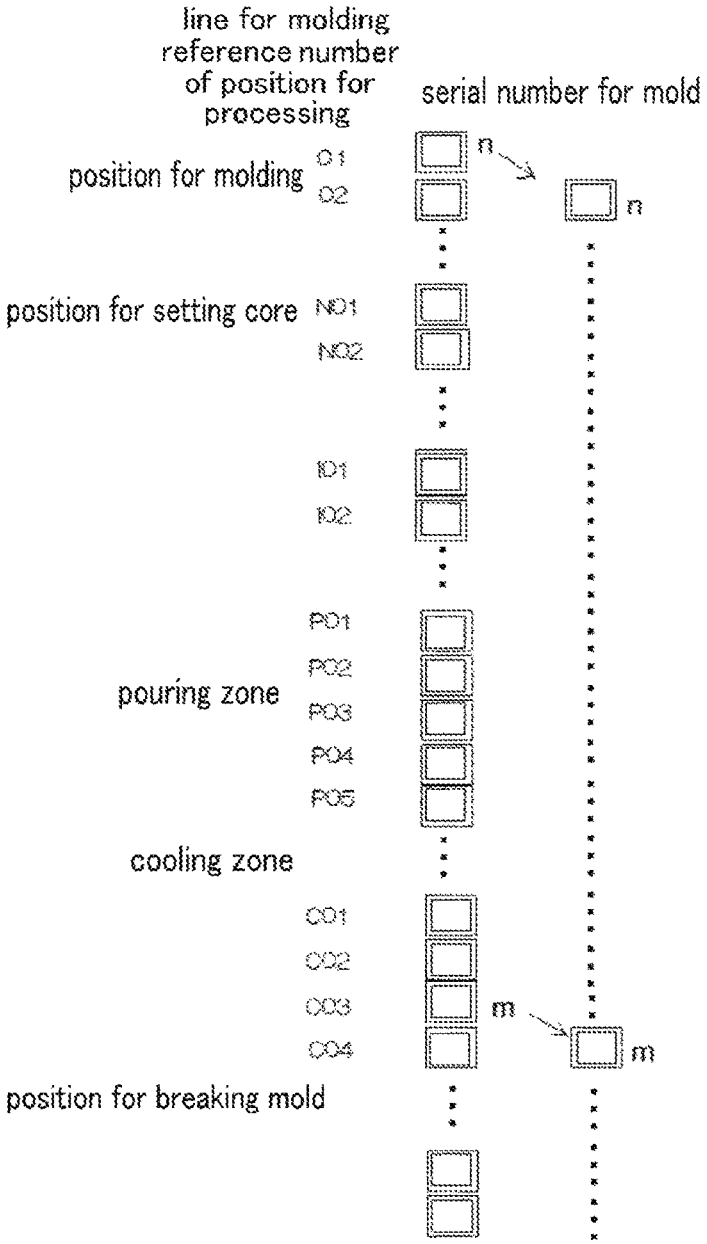
FIG. 8 is a schematic diagram illustrating how the serial number for a mold is shifted.

As in FIG. 8, the controller 31 for the unit for conveying the molds shifts the serial number for the mold by detecting the conveyance of the mold by means of the sensor 39 for the position of the mold each time the molds are intermittently conveyed. A serial number for the mold, "n," is issued to a mold that is molded by the molding machine 14. When the unit 30 for conveying the molds detects that the molds are conveyed by a distance to the next mold, the serial number "n" is shifted to the next position. The serial numbers for the mold are assigned to all positions where the molds stop when they are intermittently conveyed. All the serial numbers for the mold are shifted. Thus the serial number for the mold correctly corresponds to the position of the mold.

Based on the data on the plan for transporting the molten metal, the unit 50 for transporting the molten metal operates the bogie 52 for receiving molten metal that has a mechanism for transferring and the bogie 54 for transporting the ladle for pouring based on the data on the transporting plan of the molten metal. The ladle L1 for reacting that is empty is first transported to the position P1 for putting the alloyed metal by means of the bogie 52 for receiving molten metal that has a mechanism for transferring. When the ladle L1 for reacting is transported to the position P1 for putting the alloyed metal, an alloyed metal is put from the unit 60 for feeding an alloyed metal into the ladle L1 for reacting. Incidentally, the alloyed metal may include an inoculant.

The unit 60 for feeding an alloyed metal puts the alloyed metal into the ladle L1 for reacting based on the data on the plan for putting the alloyed metal. When the alloyed metal is put into the ladle L1 for reacting, the controller 61 for the unit for feeding an alloyed metal issues a serial number for the ladle to the ladle L1 for reacting. The data on the characteristics for recording the put alloyed metal, such as the kind, the weight, the time at which the alloyed metal is put, etc., of the alloyed metal that has been put from the unit 60 for feeding an alloyed metal into the ladle L1 for reacting, are linked with the serial number for the ladle. When the serial number for the ladle and the data on the characteristics for recording the put alloyed metal are determined, these data are sent to the computer 91 for controlling the casting plant. Further, at least the serial number for the ladle is sent to the controller 51 for the unit for transporting the molten metal. Incidentally, the serial number for the ladle and the data on the characteristics for recording the put alloyed metal may be sent to the controller 51 for the unit for transporting the molten metal, not to the computer 91 for controlling the casting plant. In this case, the controller 51 for the unit for transporting the molten metal sends the data on the conditions of the molten metal, which is the data on characteristics for recording the molten metal that include those data, to the computer 91 for controlling the casting plant. The data on the conditions of the molten metal may include the data on a plan for the molten metal. Incidentally, if trouble occurs in putting the alloyed metal into the ladle L1 for reacting in the unit 60 for feeding an alloyed metal, information on the trouble is linked with the serial number for the ladle to be sent to the computer 91 for controlling the casting plant.

The ladle L1 for reacting into which the alloyed metal has been put is transported to the position P2 for receiving the molten metal by means of the bogie 52 for receiving molten metal that has a mechanism for transferring of the unit 50 for transporting the molten metal. The ladle L1 for reacting receives molten metal from the furnace F. After receiving the molten metal, the weight of the molten metal is measured by the load cell 525, acting as the first weighing scale, and the temperature of it is measured by the noncontact thermometer. The controller 51 for the unit for transporting the molten metal links data on the conditions of the molten metal, such as the weight, the temperature, the reference number of the furnace, the reference number of tapping from the furnace, the reference number of the material, the time at which the molten metal is received, and so on, with the serial number for the ladle of the ladle L1 for reacting. Further, it may receive the data on the properties of the molten metal that has been melted by the furnace F to have those data included in the data on the conditions of the molten metal. Incidentally, the molten metal that is melted in the furnace, the molten metal that is received by the ladle for reacting, and the molten metal that has reacted with the alloyed metal, are just called "molten metal."

The ladle L1 for reacting that has received the molten metal is transported to the position. P3 for reaction by means of the bogie 52 for receiving molten metal that has a mechanism for transferring. When the molten metal and the alloyed metal violently react, the alloyed metal is covered with a covering material, such as steel scrap, by means of the unit 60 for feeding an alloyed metal after the alloyed metal has been put into the ladle L1 for reacting, to prevent the alloyed metal from contacting the molten metal. Thus a violent reaction that might occur immediately after the ladle L1 for reacting receives the molten metal can be prevented. So the ladle L1 for reacting can be transported to the position P3 for reaction. If the alloyed metal includes spheroidizing elements such as Mg, violent bubbling occurs when the reaction starts. Thus the measurements by the load cell 525 significantly change. The time when the measurements of the load cell 525 significantly change and then become smaller than a predetermined value can be determined as the start of fading. The controller 51 for the unit for transporting the molten metal may link the time when the fading starts or the period of time to fade, which is the time that has elapsed since the time the fading starts, as the data on the conditions of the molten metal, with the serial number for the ladle. The time when the fading starts or the period of time to fade, which is linked with the serial number for the ladle, is sent to the controller 71 for the unit for pouring the molten metal. In this way, by the controller 71 for the unit for transporting the molten metal the data on the conditions of the molten metal are collected to be linked with the serial number for the ladle, while the ladle L1 for reacting and the ladle L2 for pouring are being transported.

When the reaction of the molten metal with the alloyed metal finishes, the ladle L1 for reacting is transported by means of the bogie 52 for receiving molten metal that has a mechanism for transferring to the position P4 for transferring the molten metal between the ladles. The ladle L2 for pouring that is empty has been transported by means of the bogie 54 for transporting the ladle for pouring to the position P4 for transferring the molten metal between the ladles, and stays in that position. There the molten metal is transferred from the ladle L1 for reacting to the ladle L2 for pouring. By the bogie 52 for receiving molten metal that has a mechanism for transferring the ladle L1 for reacting is lifted to a proper height by means of the scissor lift 524 and is tilted, to transfer the molten metal. Thus the operation for transferring is safe and efficient. During the transportation of the ladle L1 for reacting it is lowered, and is moved to a position near the center of the travelling bogie 520. Thus the effects caused by the shaking of the travelling bogie 520 can be decreased. (12/13)

When the transfer is finished, the serial number for the ladle that has been linked with the ladle L1 for reacting is linked with the ladle L2 for pouring. Thereafter the bogie 52 for receiving molten metal that has a mechanism for transferring transports the ladle L1 for reacting to the position P1 for putting the alloyed metal. Then the operations are repeated from the step of putting the alloyed metal into the ladle L1 for reacting. Incidentally, two of the ladle L2 for pouring and two of the pouring machine 72 may be provided so that the molten metal is transferred from the ladle L1 for reacting to the two ladles L2 for pouring. If' pouring the molten metal into the molds takes a long time, multiple pouring machines 72 are used to pour the molten metal from the ladles L2 for pouring to the molds M. Thus the efficiency of the casting plant 1 increases. If the molten metal is transferred from the ladle L1 for reacting to the two ladles L2 for pouring, the serial number for the ladle L1 for reacting and a datum that indicates that the ladle L2 for pouring is the second one that has been transferred from the ladle L1 for reacting are linked with the second ladle L2 for pouring. Incidentally, an inoculant may be added, by means of the device 56 for inoculating, to the molten metal that is being transferred from the ladle L1 for reacting to the ladle L2 for pouring. The controller 51 for the unit for transporting the molten metal links data on the conditions of the molten metal, which include the kind of inoculant, the weight of it, and the time for adding it, with the serial number for the ladle.

When the molten metal is transferred to the ladle L2 for pouring, the bogie 54 for transporting the ladle for pouring transports the ladle L2 for pouring to the position P5 for transferring. The ladle L2 for pouring is transferred by means of the mechanism 58 for transporting the ladle for pouring from the position P5 for transferring the ladle to the position PG to pour the molten metal, to be held by the pouring machine 72. The controller 51 for the unit for transporting the molten metal sends the serial number for the ladle and the data on the conditions of the molten metal that are linked with the serial number for the ladle to the computer 91 for controlling the casting plant. Incidentally, if trouble occurs in transporting the molten metal at the unit 50 for transporting the molten metal, then information on that trouble is linked with the serial number for the ladle to be sent to the computer 91 for controlling the casting plant.

Figure 9:
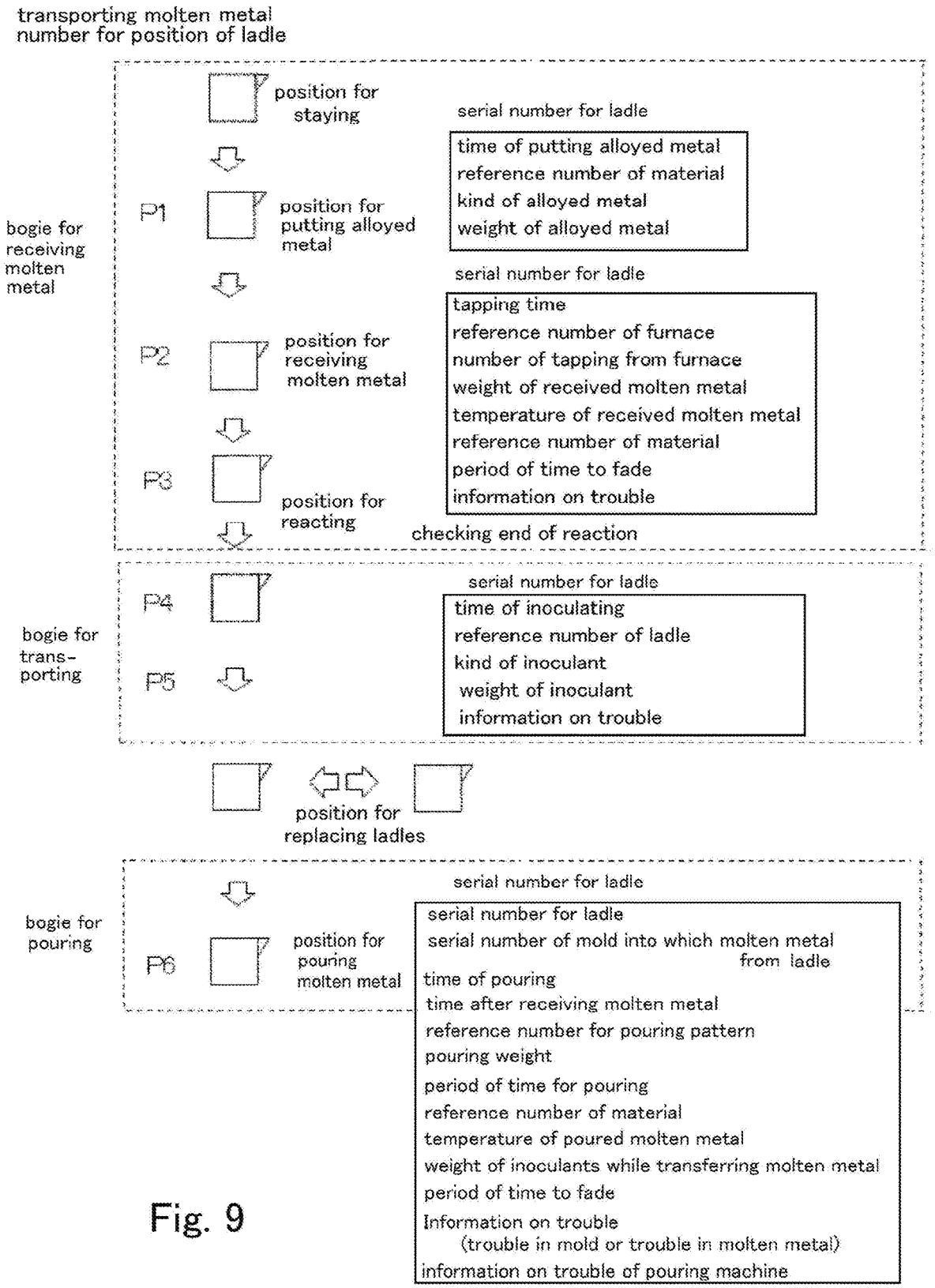
FIG. 9 is a schematic diagram illustrating the serial number for the ladle at the position of the ladle and the data on the conditions of the molten metal that are linked with the serial number for the ladle.

As in FIG. 9, the unit 50 for transporting the molten metal detects the ladle L1 for reacting or the ladle L2 for pouring that is located at the position P1 for putting the alloyed metal, the position P2 for receiving the molten metal, the position P3 for reaction, the position P4 for transferring the molten metal between the ladles, or the position P5 for transferring the ladle, by means of the sensor 59 for detecting the ladle or the encoder 523, 543, to shift the serial number for the ladle. Further, it links the data on the conditions of the molten metal with the serial number for the ladle. Thus the position of the ladle L1 for reacting or the ladle L2 for pouring correctly corresponds to the serial number for the ladle. Thus the data on the conditions of the molten metal that have been obtained from the different devices are correctly linked with the serial number for the ladle.

When the mold M is conveyed to the front of the pouring machine 72, the controller 31 for the unit for conveying the molds sends the serial number for the mold M to the controller 71 for the unit for pouring the molten metal. The controller 71 for the unit for pouring the molten metal receives the data on the pouring plan from the computer 91 for controlling the casting plant. Further, it receives the serial number for the ladle, the weight of received molten metal, an allowable period of time to fade, the time when the fading starts, the period of time to fade, and so on, of the ladle L2 for pouring from the controller 51 for the unit for transporting the molten metal. Incidentally, the controller 71 for the unit for pouring the molten metal may receive the data on the time the fading starts, to measure the period of time to fade, without receiving the data on the period of time to fade.

The controller 71 for the unit for pouring the molten metal compares the material of the molten metal derived from the data on the pouring plan that corresponds to the serial number for the mold of the mold M, namely, the kind of alloyed metal, the weight of it, the weight of the molten metal, etc., to the material of the molten metal derived from the data on the conditions of the molten metal that correspond to the serial number for the ladle of the ladle L2 for pouring. If these two materials are inconsistent, the controller 71 for the unit for pouring the molten metal sends an error signal. In this case the molten metal is not poured into the mold M, but is returned to the melting furnace F. The ladle L2 for pouring may be suspended by a crane to return the molten metal to the melting furnace F. Alternatively, a dedicated device (not shown) may be provided to return the molten metal to the melting furnace F.

When the pouring machine 72 receives the ladle L2 for pouring, the weight of the molten metal in the ladle L2 for pouring is measured by a load cell 725, which is the second weighing scale. Then the measured weight is compared to the weight that is linked with the same serial number for the ladle, which weight has been measured by the load cell 525. If the difference between the weights is larger than a predetermined value, the controller 71 for the unit for pouring the molten metal sends an error signal. This is because the possibility that the molten metal will spill or leak during the transportation is high.

The controller 71 for the unit for pouring the molten metal causes the ladle L2 for pouring to pour the molten metal into the mold M, based on the data on the pouring plan. First, it causes the ladle L2 for pouring to move toward the mold M by means of the mechanism 728 for moving the ladle back and forth and to move up and down by means of the mechanism 722 for vertically moving the lade, based on the information on the height of the mold and position of the sprue, which information is linked with the serial number for the mold. It causes the lip for pouring to move by means of the mechanism 722 for vertically moving the ladle and the mechanism 728 for moving the ladle back and forth and causes the ladle L2 for pouring to tilt by means of the mechanism 724 for tilting the ladle, to pour the molten metal into the mold M.

The controller 71 for the unit for pouring the molten metal memorizes pouring patterns and pours the molten metal into the mold by the pouring pattern that is applied to the mold M that is linked with the serial number for the mold. While pouring the molten metal, the camera 726 for detecting the surface of the molten metal takes a digital image of the sprue. The controller 71 for the unit for pouring the molten metal computes the level of the surface of the molten metal based on the digital image, to control the mechanism 724 for tilting the ladle to tilt the ladle L2 for pouring. Further, while pouring the molten metal, the weight of the molten metal in the ladle L2 for pouring is measured by means of the load cell 725 so that the controller 71 for the unit for pouring the molten metal computes the quantity of the molten metal that has been poured into the mold M. When that amount approaches the target, the pouring is stopped. Incidentally, the mold M is intermittently conveyed in front of the pouring machine 72, like it is conveyed in other positions. Thus, if the pouring into the mold M is not completed during the time it stops there, the bogie 720 for the pouring machine can travel at the same rate as the mold M, to continue pouring. If the period of time for pouring by the pouring machine 72 is longer than each interval during which a mold is intermittently conveyed, two pouring machines may be used. That is, two ladles L2 for pouring can be used.

The controller 71 for the unit for pouring the molten metal compares the actual period of time to fade to an allowable period of time to fade. If the actual period of time to fade exceeds the allowable period of time to fade, it sends an error signal. Further, pouring from the ladle L2 for pouring is discontinued, even though the molten metal remains in the ladle L2 for pouring. Thus poor spheronizing caused by fading can be prevented. The molten metal that remains in the ladle L2 for pouring is returned to the melting furnace F by means of a device for returning the molten metal to the melting furnace F. The molten metal is to be reused.

The unit 76 for collecting a test piece receives the molten metal from the ladle L2 for pouring to solidify it as a test piece (TP). It receives the molten metal before the ladle L2 for pouring starts pouring the first mold, at an interval between having finished the pouring of one mold and starting to pour another, or after the ladle L2 for pouring finishes pouring the last mold. When collecting the TP, the controller 71 for the unit for pouring the molten metal issues a serial number for a test piece (TP). The serial number for the TP is linked with the serial number for the ladle. Later the material of the TP is tested. The results of the test are linked with the serial number for the TP and are sent to the computer 91 for controlling the casting plant. The unit 76 for collecting a test piece may have a controller for the unit for collecting a test piece to issue the serial number for the TP. In this case, the serial number for the TP is sent to the controller 71 for the unit for pouring the molten metal and is linked with the serial number for the ladle there. The controller for the unit for collecting a test piece is regarded as a part of the controller 71 for the unit for pouring the molten metal. If some poor material is found in the test of the material of the TP, the serial number for that TP is sent to the computer 91 for controlling the casting plant. The serial number for the ladle is found based on the serial number for the TP. The information on the poor material of the TP is linked with the serial number for the mold. The shake-out machine 48, which is discussed later, processes a mold as a defective product, when the serial number for the mold is linked with an error signal (the information on the poor material of the TP).

The controller 71 for the unit for pouring the molten metal measures the number of molds into which the molten metal from the same ladle L2 for pouring is poured, the time of the pouring, the reference number of the pouring pattern, the weight of poured molten metal and the period of time for pouring, the temperature of the poured molten metal, and so on. These data are linked with the serial number for the ladle as parts of the data on the conditions of the molten metal. The serial number for the ladle L2 for pouring, which ladle L2 pours the molten metal into the mold M, is linked with the serial number for the mold M. After the linking is completed, the controller 71 for the unit for pouring the molten metal sends the data to the computer 91 for controlling the casting plant. Incidentally, if trouble occurs in pouring the molten metal from the ladle L2 for pouring into the mold M at the unit 70 for pouring the molten metal, the information on the trouble is linked with the serial number for the mold, to be sent to the computer 91 for controlling the casting plant.

By the unit 30 for conveying the molds the mold M into which the molten metal has been poured is conveyed into a zone 34 for cooling. In the zone 34 for cooling the rail RF is long, so that conveying the mold M takes a long time. During that long time the molten metal in the mold M is cooled and solidified. When the mold M is conveyed to the shake-out machine 48, which is located downstream of the zone 34 for cooling, the mold M is broken and the cast product is separated from the sand. The cast product is sent to a post-process to be a final product. The sand is sent to the unit 10 for molding via a device for recovering molding sand (not shown). If an error signal (the information on the poor material of the TP) is linked with the serial number for the mold M that has been conveyed to the shake-out machine 48, the controller 31 for the unit for conveying the molds distinguishes the cast product that has been separated from the sand so that it is not sent to the post-process. Thus a defective product can be prevented from being shipped as a final product. The controller 31 for the unit for conveying the molds links the cast product that is to be sent to the post-process with the serial number for the mold. Further, it sends the serial number for the mold and the data on the characteristics for recording the molding to the computer 91 for controlling the casting plant.

The computer 91 for controlling the casting plant stores the serial number for the mold, the data for molding the mold, the serial number for the ladle, the data on the conditions of the molten metal, and the results of the material test of the TP. The mold that has been manufactured by the casting plant 1 is linked with the serial number for the mold. Thus the serial number for the mold and the serial number for the ladle can be found from the cast product. The data for molding the mold are linked with the serial number for the mold. The data on the conditions of the molten metal are linked with the serial number for the ladle. Thus all the data on the characteristics for recording are linked with the cast product. If a defect is found in the cast product, the data on the characteristics for recording can be checked. A great amount of data on the conditions of the molten metal can be managed for each ladle. The data can be extracted for each ladle based on the serial number for the mold that is linked with the mold. Thus the volume to store the data can be reduced.

If the serial number for the individual piece is issued to each space of a mold, a cast product can be identified by the serial number for the individual piece. Thus, if a deficiency is found by testing a product, the serial number for the mold can be extracted from the serial number for the individual cast product, so that the data on the characteristics for recording the molding and the data on the conditions of the molten metal can be found based on that serial number for the mold.

Figure 10:
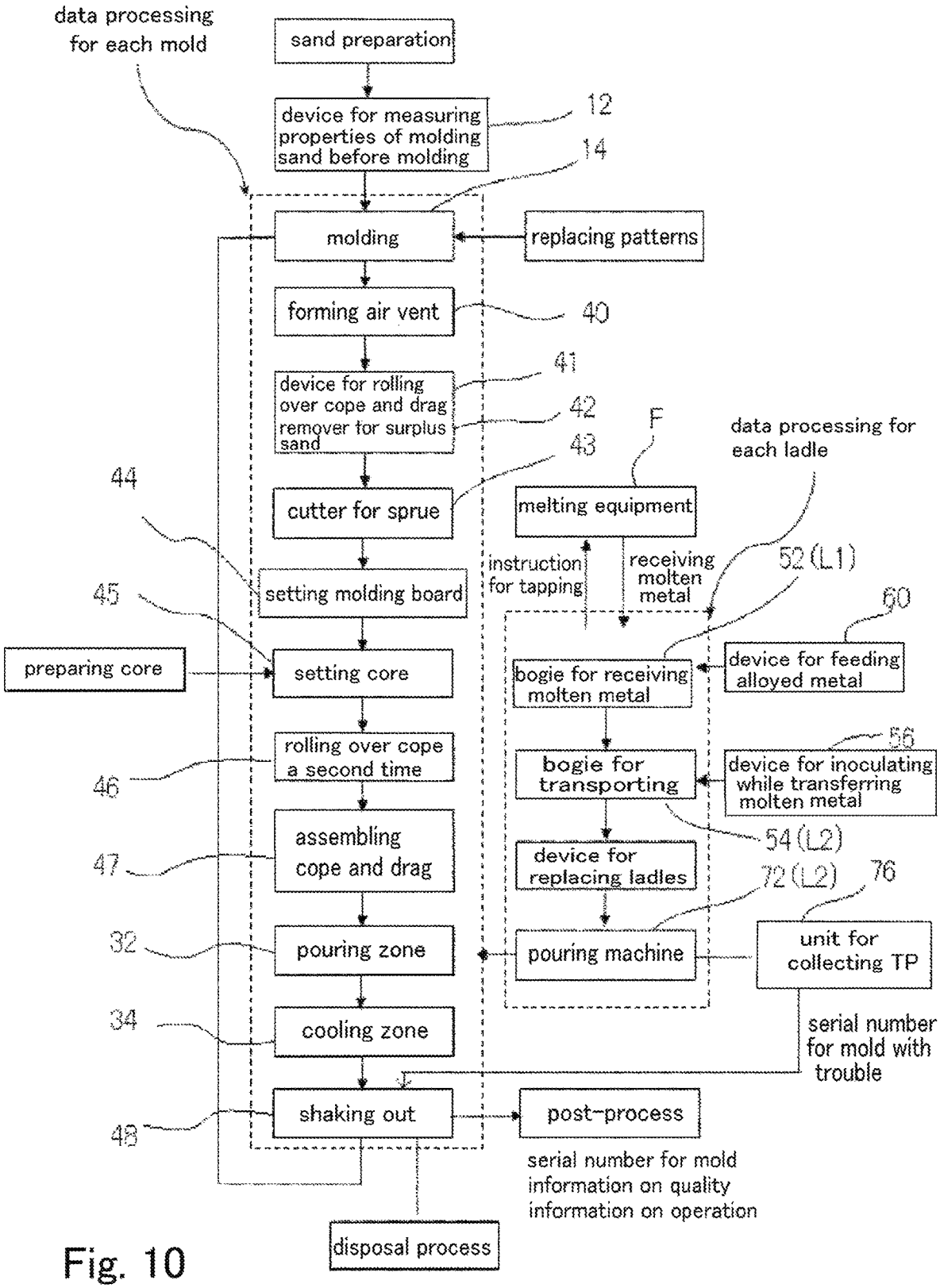
FIG. 10 is a flowchart illustrating the flow of the data in the casting plant.

Now, with reference to FIG. 10, processing data on each mold and processing data on each ladle are collectively discussed. A mold is molded by the molding machine 14 by using the molding sand that has been subject to sand preparation and of which the properties have been measured by the device for measuring the properties of the molding sand before molding. A serial number for the mold is issued to each finished mold. After the issuance, the data on the mold are processed by using that serial number for the mold. Incidentally, changes of the shape, etc., of molds can be made by replacing flasks, patterns, etc., that are used by the molding machine 14. Treatments to the mold, such as forming an air vent, rolling over the flasks, removing surplus sand, cutting a sprue, setting a molding board, setting a core, rolling over the cope a second time, and assembling the cope and drag, are stored for each mold by using the data on the mold.

When an alloyed metal is put in the ladle L1 for reacting that is mounted on the bogie 52 for receiving molten metal that has a mechanism for transferring, a serial number for the ladle is issued to the ladle L1 for reacting. After the issuance, the data on the ladle are processed by using that serial number for the ladle. Data on the movement of the ladle L1 for reacting to the position P2 for receiving the molten metal, to the position P3 for reaction, and to the position P4 for transferring the molten metal between the ladles, receipt of the molten metal from the melting furnace F, the transfer of the molten metal to the ladle L2 for pouring that is mounted on the bogie 54 for transporting the ladle for pouring, the movement of the ladle L2 for pouring to the position P5 for transferring the ladle, the transfer of the ladle L2 for pouring to the pouring machine 72, the pouring of the molten metal into the mold by the pouring machine 72, and the collection of the TP by the unit 76 for collecting a test piece, are processed by using the data on each ladle. The records (the data on the conditions) are stored for each ladle.

When the molten metal is poured into the mold by the pouring machine 72, the serial number for the ladle is linked with the serial number for the mold. The data that are linked with the serial number for the ladle can be extracted by using the serial number for the mold. Namely, since the cooling time of the mold in the zone for cooling varies, for example, depending on the weight of the molten metal that has been poured, the distance to be conveyed in the zone for cooling may be changed based on the weight of the molten metal, which weight is extracted by using the serial number for the mold. Specifically, a traverser T that is used for transferring the mold to the next rail Rf for molds, or a rail Rf for molds, to which the mold is transferred by the traverser T, may be changed. Further, when the mold is broken by the shake-out machine 48, the data on the conditions of the molten metal, which are extracted by using the serial number for the mold, might include a datum that indicates poor quality if so, the cast product that has been taken out is separated from the final cast products, to be thrown away.

Figure 11:
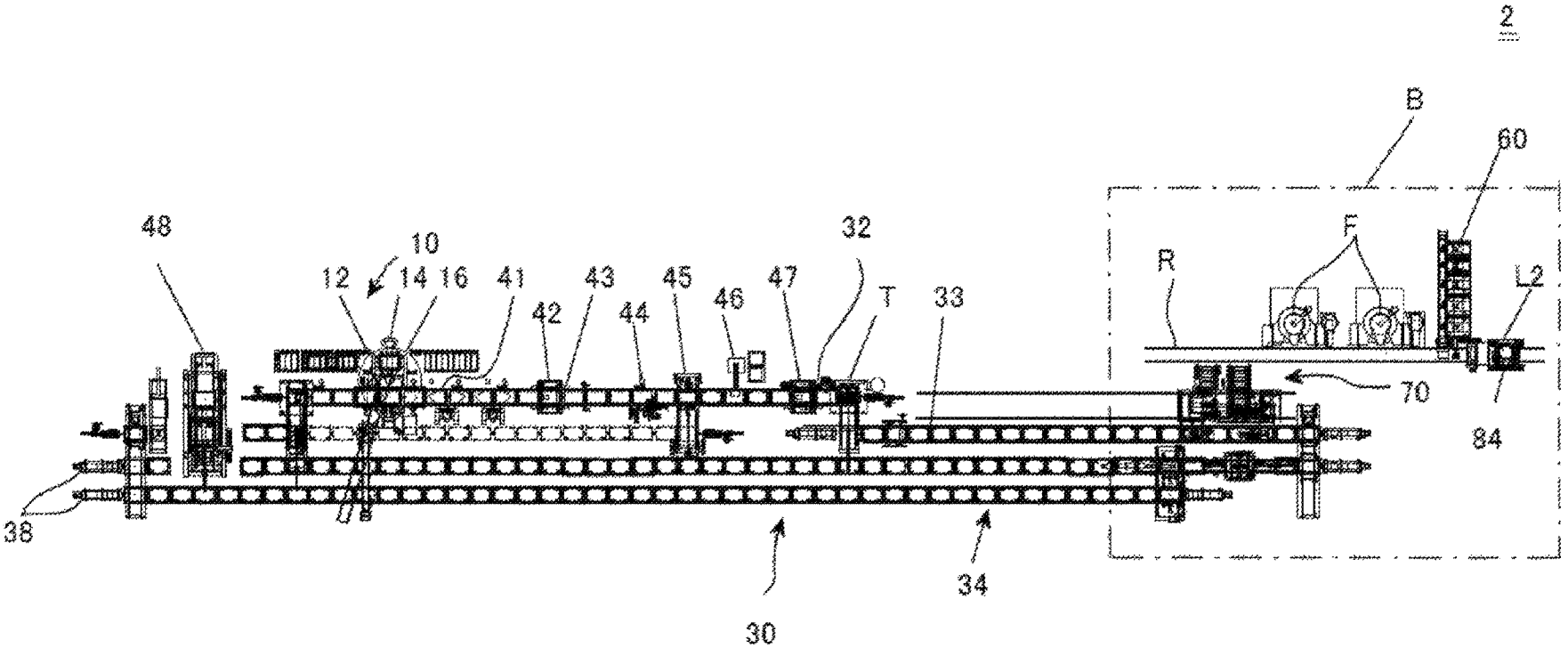
FIG. 11 is a plan view illustrating the configuration of the casting plant. It shows the casting plant in which molten metal is received from the furnace by a ladle for pouring and is poured from the ladle for pouring into a mold.
Figure 12:
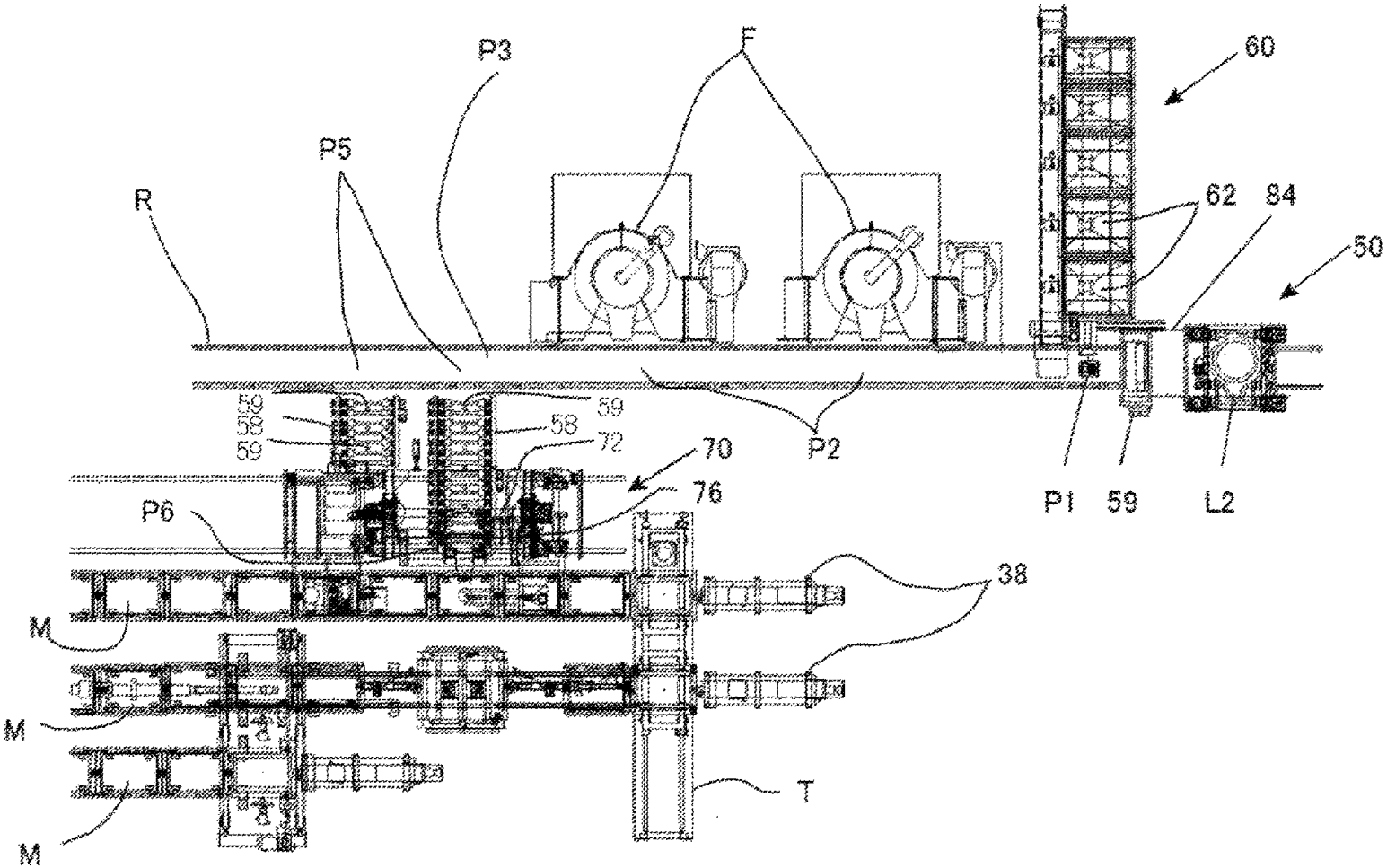
FIG. 12 is an enlarged view of part B in FIG. 11.

Next, with reference to FIGS. 11 and 12, the casting plant 2, which differs from the casting plant 1 as in FIG. 1, is discussed. By the casting plant 2, the ladle L2 for pouring receives the molten metal from the furnace F and is transferred to the pouring machine 72 without transferring the molten metal. Since the other configuration is the same as that of the casting plant 1, any duplicate explanation is omitted and only the different points are discussed. When the reaction of the molten metal with the alloyed metal is not so violent, there is no need for the ladle L1 for reacting to be used. The ladle L2 for pouring can receive the molten metal to cause the molten metal to react with the alloyed metal in it.

The unit 50 for transporting the molten metal has a unit 60 for feeding an alloyed metal. It also has a bogie 84 for transporting the ladle for pouring that transports the ladle L2 for pouring to the position. P1 for putting the alloyed metal, the position P2 for receiving the molten metal, the position P3 for reaction, and the position P5 for transferring the ladle. It also has a rail R on which the bogie 84 for transporting the ladle for pouring travels. It also has a mechanism 58 for transporting the ladle for pouring, which mechanism transports the ladle L2 for pouring from the position P5 for transferring the ladle to the pouring machine 72. When the reaction of the molten metal with the alloyed metal is mild, the molten metal may react with the alloyed metal while the ladle L2 for pouring is being transported, without determining the position P3 for reaction.

Figure 13:
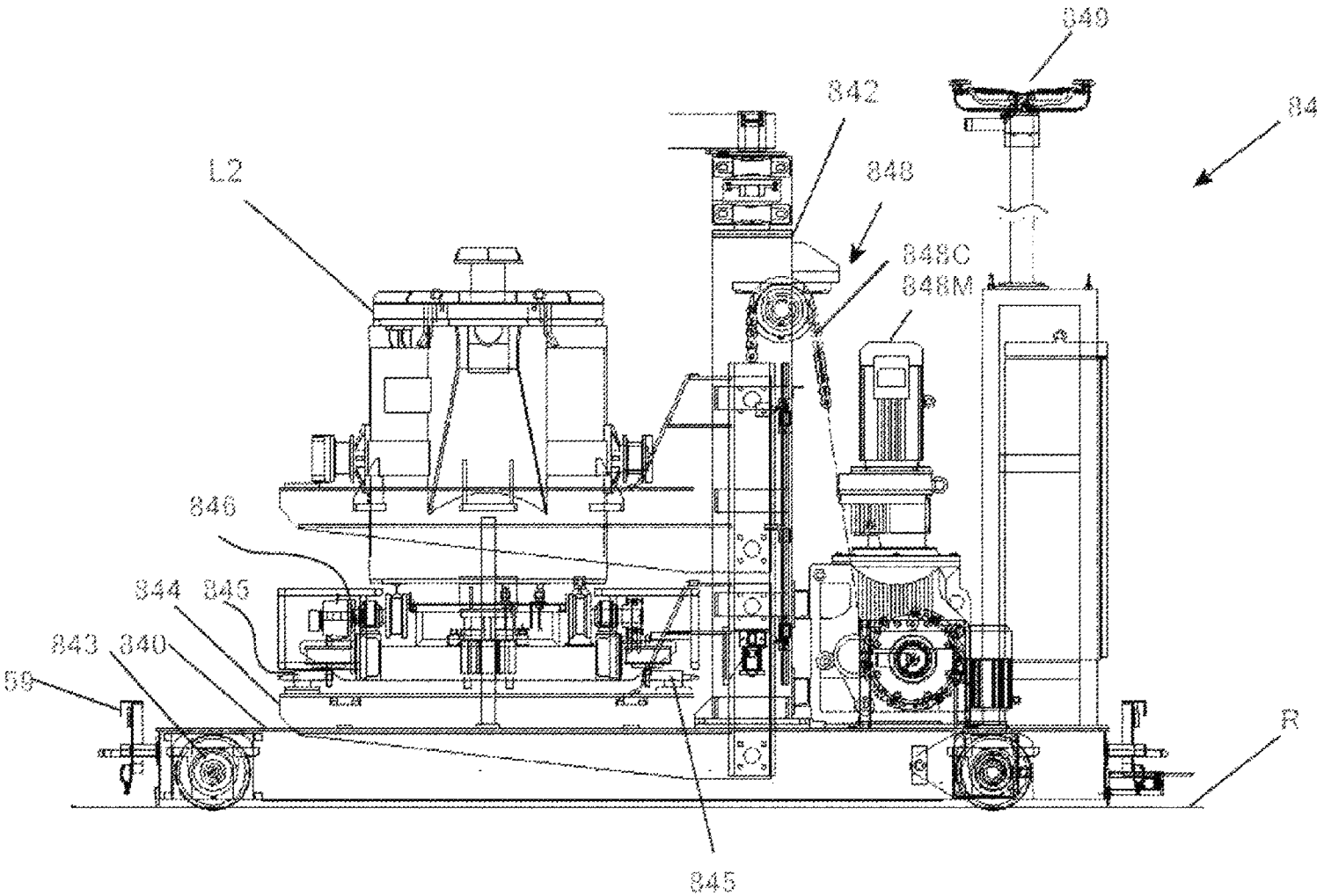
FIG. 13 is a side view of a bogie for transporting the ladle for pouring with a mechanism for moving the ladle up and down.

As in FIG. 13, the bogie 84 for transporting the ladle for pouring has a travelling bogie 840 that travels on the rail R. It also has guiding columns 842 that are provided on the travelling bogie 840. It also has a frame 844 for moving up and down that horizontally extends from the guiding columns 842 and that moves up and down above the travelling bogie 840. It also has a mechanism 846 for moving the ladle, which mechanism is provided on the frame 844 for moving up and down and horizontally moves the ladle L2 for pouring. It also has a driver 848 for the frame for moving up and down, which driver moves the frame 844 up and down. The driver 848 for the frame for moving up and down winds a chain 848C by the rotation of a motor 848M, to vertically move the frame 844 for moving up and down. For example, the time when the melting furnace F was constructed differs from the time when the unit 70 for pouring the molten metal was constructed, so that their levels differ. However, since the bogie 84 for transporting the ladle for pouring has a mechanism for moving the ladle L2 for pouring up and down, the difference in the levels can be absorbed. The bogie 84 for transporting the ladle for pouring has a load cell 845 (the first weighing scale) that weighs the molten metal that has been received from the furnace F. It also has a noncontact thermometer (not shown) that measures the temperature of the received molten metal.

In the bogie 84 for transporting the ladle for pouring, power-receiving equipment 849 that receives power from outside and a motor 848M are located at high levels and apart from the ladle L2 for pouring. Thus if the molten metal were to leak from the ladle L2 for pouring, these devices would not be damaged from such an accident. The high levels may be any level that is higher than the bottom of the ladle L2 for pouring while the bogie 84 for transporting the ladle for pouring travels, namely, when the frame for moving up and down is lowered. A position that, is apart from the ladle L2 for pouring may be on the other side of the guiding columns 842.

In the casting plant 2, when the alloyed metal is put from the unit 60 for feeding an alloyed metal into the ladle L2 for pouring, a serial number for the ladle is issued to the ladle L2 for pouring. The data on the conditions of the molten metal are linked with the serial number for the ladle. When the molten metal is poured from the pouring machine 72 into the mold M, the serial number for the ladle is linked with the serial number for the mold. Thus the advantageous effects that are the same as those of the casting plant 1 can be achieved.

The data communications between the controllers 11, 31, 51, 61, and 71 for the respective units and the computer 91 for controlling the casting plant are not limited to those described above, but may be altered as appropriate. The data on the plans, the data on the characteristics for recording the molding, and the data on the conditions of the molten metal that are discussed above, are just examples. Data other than them may be used.

Below, the main reference numerals and symbols that are used in the detailed description and drawings are listed.

1, 2 the casting plant
10 the molding unit
11 the controller for the molding unit

12 the device for measuring properties of molding sand before molding
14 the molding machine
16 the device for engraving
30 the unit for conveying the molds
31 the controller for the unit for conveying the molds
32 the line for molding
33 the zone for pouring the molten metal into the unit for conveying the molds
34 the zone for cooling in the unit for conveying the molds
37 the encoder for detecting the position of the mold
38 the pusher for the molds (the mechanism for conveyance)
39 the sensor for the position of the mold
40 the device for drilling a gas vent
41 the device for rolling over the cope and drag
42 the remover for surplus sand
43 the cutter for a sprue
44 the device for setting a molding board
45 the device for setting a core
46 the device for rolling over the cope a second time
47 the device for assembling the molds
48 the shake-out machine
50 the unit for transporting the molten metal
51 the controller for the unit for transporting the molten metal
52 the bogie for receiving molten metal that has a mechanism for transferring the molten metal
54, 84 the bogie for transporting the ladle for pouring
56 the device for inoculating while transferring the molten metal
58 the mechanism for transporting the ladle for pouring
59 the sensor for detecting the ladle
60 the unit for feeding an alloyed metal
61 the controller for the unit for feeding an alloyed metal (the controller for the device for feeding an alloyed metal)
62 the hoppers for an alloyed metal
70 the unit for pouring the molten metal (the unit for transporting the molten metal)
71 the controller for the unit for pouring the molten metal
72 the pouring machine
76 the unit for collecting a test piece (TP)
91 the computer for controlling the casting plant
520 the travelling bogie
521 the control panel
522 the motor for travelling
523 the encoder (the sensor for detecting the ladle)
524 the scissor lift (the mechanism for moving a ladle up and down)
525 the load cell (the first weighing scale)
526 the device for tilting the ladle
527 the motor for tilting
528 the cable reel
540 the travelling bogie
541 the control panel
542 the motor for travelling
543 the encoder (the sensor for detecting the ladle)
544 the roller conveyor
546 the motor for the roller conveyor
548 the cable reel
720 the bogie for the pouring machine
722 the mechanism for vertically moving the ladle
724 the mechanism for tilting the ladle
725 the load cell (the second weighing scale)
726 the camera for detecting the surface of the molten metal
728 the mechanism for moving the ladle back and forth
840 the travelling bogie
842 the guiding columns
843 the encoder
844 the frame for moving up and down
845 the load cell (the first weighing scale)
846 the mechanism for moving the ladle
848 the driver for the frame for moving up and down
849 the power-receiving equipment
F the melting furnace
L1 the ladle for reacting
L2 the ladle for pouring
M the mold
P1 the position for putting the alloyed metal
P2 the position for receiving the molten metal
P3 the position for reaction
P4 the position for transferring the molten metal between the ladles
P5 the position for transferring the ladle
P6 the position to pour the molten metal
R the rail
Rf the rail for molds
Rp the rail for the pouring machine
T the traverser

The invention claimed is:

1. A casting plant, wherein a mold is molded and conveyed to a position where molten metal can be poured into the mold, and wherein the molten metal is poured into the mold to produce a cast product, the casting plant comprising:

a molding unit that molds the mold from molding sand;

a unit for conveying the mold that conveys the mold;

a unit for pouring the molten metal that pours the molten metal into the mold that has been conveyed by means of the unit for conveying the mold; and a computer for controlling the casting plant, wherein the molding unit has a molding machine that molds the mold and a controller for the molding unit that controls operations of the molding machine, wherein the controller for the molding unit receives data on a molding plan from the computer for controlling the casting plant to control the molding machine so that the mold is molded based on the molding plan that is derived from the data on the molding plan, and the controller for the molding unit issues a serial number for the mold that has been molded and links the data on the mold with the serial number for the mold, wherein the unit for conveying the mold has a mechanism for conveyance that intermittently conveys the mold by a distance to the next mold, a sensor for detecting the position of the mold that detects the mold that has been conveyed, and a controller for the unit for conveying the mold that controls operations of the unit for conveying the mold, wherein the controller for the unit for conveying the mold controls the mechanism for conveyance so that the mold is intermittently conveyed, the controller for the unit for conveying the mold receiving the serial number for the mold, which mold has been molded by the molding machine and is ready to be conveyed by the mechanism for conveyance, the controller for the unit for conveying the mold sequentially shifting each serial number for the mold that is assigned to the position of the mold that stops in accordance with a movement of the mold, which is detected by means of the sensor for detecting the position of the mold, so that the serial number for the mold, which serial number is assigned to the position of the mold, accords with the actual position of the mold, wherein the unit for pouring the molten metal has a pouring machine that pours molten metal from a ladle for pouring into the mold and a controller for the unit for pouring the molten metal that controls operations of the pouring machine, wherein the controller for the unit for pouring the molten metal receives a serial number for the ladle that is linked with the data on the conditions of the molten metal in the ladle for pouring and also receives from the controller for the unit for conveying the mold the serial number for the mold that is located at the position to pour the molten metal, the controller for the unit for pouring the molten metal controlling the pouring machine so that the molten metal is poured based on a pouring plan that is derived from the data on the pouring plan that corresponds to the serial number for the mold, the controller for the unit for pouring the molten metal linking the serial number for the ladle for pouring, which ladle is used for pouring, with the serial number for the mold, to send them to the computer for controlling the casting plant.

2. The casting plant of claim 1, further comprising a unit for transporting the molten metal to transport the molten metal from a furnace to the pouring machine, wherein the unit for transporting the molten metal has:

a ladle for reacting that receives the molten metal from the furnace and transfers the molten metal to the ladle for pouring;

a device for feeding an alloyed metal that puts the alloyed metal into the ladle for reacting;

the ladle for pouring, to which the molten metal that has reacted with the alloyed metal is transferred from the ladle for reacting, and which ladle for pouring is transported to the pouring machine;

a bogie for receiving molten metal that has a mechanism for transferring the molten metal, the bogie transporting the ladle for reacting to a position for putting the alloyed metal where the alloyed metal is put from the device for feeding the alloyed metal into the ladle for reacting, to a position for receiving the molten metal where the ladle for reacting receives the molten metal from the furnace, and to a position for transferring the molten metal where the molten metal is transferred from the ladle for reacting to the ladle for pouring;

a bogie for transporting the ladle for pouring, which bogie transports the ladle for pouring to the position for transferring the molten metal and to a position for transferring the ladle where the ladle for pouring is transferred to the pouring machine;

a sensor for detecting the ladle, which sensor is located at a position of the ladle for reacting or a position of the ladle for pouring, to detect the ladle that is transported thereto;

a controller for the device for feeding the alloyed metal, which controller controls the device for feeding the alloyed metal so that a quantity of the alloyed metal is put into the ladle for reacting, issues a serial number for a ladle to the ladle for reacting into which the alloyed metal is put, and links data on the alloyed metal with the serial number for the ladle; and a controller for the unit for transporting the molten metal, which controller controls the bogie for receiving molten metal that has a mechanism for transferring the molten metal and controls the bogie for transporting the ladle for pouring, to transport the ladle for reacting and the ladle for pouring based on a plan for transporting the ladle and to transfer the molten metal from the ladle for reacting to the ladle for pouring, the controller for the unit for transporting the molten metal shifting the serial number for the ladle, the serial number being assigned to the position of the ladle based on the position of the ladle detected by the sensor for detecting the ladle, so that the serial number for the ladle for reacting or the ladle for pouring that is located at that position corresponds to the position of the ladle, the controller for the unit for transporting the molten metal linking the data on the conditions of the molten metal within the ladle for reacting with the serial number for the ladle, wherein the controller for the unit for transporting the molten metal sends the serial number for the ladle for pouring that has been transferred to the pouring machine to the controller for the unit for pouring the molten metal.

3. The casting plant of claim 2, wherein the unit for transporting the molten metal has a first weighing scale that weighs molten metal that has been received from the furnace, wherein the unit for pouring the molten metal has a second weighing scale that weighs molten metal in the ladle for pouring, which ladle has been transferred from the unit for transporting the molten metal, and wherein the controller for the unit for pouring the molten metal sends an error signal if a difference between a weight that is measured by the first weighing scale and a weight that is measured by the second weighing scale exceeds an allowable difference in weights, both weights for a ladle that corresponds to a common serial number for the ladle.

4. The casting plant of claim 2, wherein the alloyed metal includes magnesium, wherein the unit for transporting the molten metal has a first weighing scale that weighs molten metal that has been received from the furnace, wherein the controller for the unit for transporting the molten metal detects a start of a fading time based on the changes of a weight that are measured by means of the first weighing scale, to send to the controller for the unit for pouring the molten metal a fading time-started signal that indicates the start of the fading time or a signal indicating a period of time after the start of the fading time, wherein the controller for the unit for pouring the molten metal sends an error signal when the period of time after the start of fading, which period of time may be obtained based on the fading time-started signal, exceeds an allowable period of time in the fading time and when pouring molten metal into a mold from the ladle for pouring, which ladle corresponds to the serial number for the ladle that is the same as that for the fading time-started signal or the signal indicating the period of time.

5. The casting plant of claim 2, wherein the data on the conditions of the molten metal include at least one of a material of the molten metal, a tapping time, a reference number of the furnace, a reference number of tapping from the furnace, a weight of received molten metal, a temperature of received molten metal, a period of time after a start of a fading time, and the data on the alloyed metal.

6. The casting plant of claim 2, wherein the position of the ladle includes at least one of the position for putting the alloyed metal, the position for receiving the molten metal, the position for transferring the molten metal between the ladles, and the position for transferring the ladle.

7. The casting plant of claim 1, further comprising a unit for transporting the molten metal that transports the molten metal from a furnace to the pouring machine, wherein the unit for transporting the molten metal has:

the ladle for pouring that receives the molten metal from the furnace and that is transferred to the pouring machine;

a device for feeding an alloyed metal that puts the alloyed metal into the ladle for pouring;

a bogie for transporting the ladle for pouring that transports the ladle for pouring to a position for putting the alloyed metal where the alloyed metal is put from the device for feeding the alloyed metal into the ladle for pouring, to a position for receiving the molten metal where the ladle for pouring receives the molten metal from the furnace, and to a position for transferring the ladle where the ladle for pouring is transferred to the pouring machine;

a sensor for detecting the ladle, which sensor is provided at a position of the ladle for pouring that is transported, and which sensor detects the ladle for pouring that has been transported;

a controller for the device for feeding the alloyed metal, which controller controls the device for feeding the alloyed metal so as to put a quantity of the alloyed metal into the ladle for pouring, and which controller issues a serial number for the ladle to the ladle for pouring into which the alloyed metal has been put and links data on the alloyed metal with the serial number for the ladle, a controller for the unit for transporting the molten metal, which controller controls the bogie for transporting the ladle for pouring so as to transport the ladle for pouring based on a plan for transporting the ladle, which controller shifts the serial number for the ladle that is assigned to the position for the ladle based on a movement of the ladle for pouring that is detected by means of the sensor for detecting the ladle, so that the serial number for the ladle for pouring corresponds with the position of the ladle, the ladle for pouring being at the position of the ladle, and which controller links the data on the molten metal within the ladle for pouring with the serial number for the ladle for pouring, and wherein the controller for the unit for transporting the molten metal sends the serial number for the ladle for pouring that has been transferred to the pouring machine to the controller for the unit for pouring the molten metal.

8. The casting plant of claim 7, wherein the bogie for transporting the ladle for pouring has a mechanism for moving a ladle up and down, which mechanism moves the ladle for pouring up and down.

9. The casting plant of claim 1, wherein the unit for conveying the mold also has a device for treating the mold to finish the mold, and wherein the controller for the unit for conveying the mold controls a treatment to finish the mold and gathers data on the treatment to link the data with the serial number for the mold.

10. The casting plant of claim 9, wherein the data for molding the mold include at least one of a reference number of a pattern, a time after applying a parting agent, a static pressure during molding, a pressure for squeezing, a quantity of supplied molding sand, a height of the mold, a thickness of the mold, a rate of compression, information on an air vent, information on a sprue, and information on a core.

11. The casting plant of claim 1, wherein the molding unit has a machine for measuring sand properties to measure the molding sand that is to be supplied to the molding machine, and wherein the controller for the molding unit links information on the sand properties that have been measured by means of the machine for measuring sand properties with the serial number for the mold.

12. The casting plant of claim 1, wherein the data on the molding plan include at least one of a reference number of a pattern, a weight of supplied sand, a time after applying a parting agent, a pressure for squeezing, a height of the mold, a thickness of the mold, and a rate of compression.

13. The casting plant of claim 1, wherein the data on the pouring plan include at least one of a pouring weight, a period of time for pouring, a material for pouring, a pouring pattern, a position of a pouring cup, a height of the mold, and an allowable period of time that fades.

14. The casting plant of claim 1, wherein the pouring machine has a unit for collecting a test piece from the ladle for pouring, and wherein the controller for the unit for pouring the molten metal issues a serial number for to the test piece that is collected by the unit for collecting the test piece and links the serial number for the ladle with the serial number for the test piece.

15. The casting plant of claim 14, wherein a signal that indicates that a material is of poor quality is linked with the serial number for the test piece that has a poor result in a test to identify the serial number for the ladle, which serial number is linked with the serial number for the test piece that is linked with the signal so as to identify the serial number for the mold, which serial number is linked with the serial number for the ladle, so that the mechanism for conveyance handles the mold that corresponds to the identified serial number for the mold in a way that is different from other molds.

16. The casting plant of claim 1, wherein the controller for the unit for pouring the molten metal sends an error signal when a material of the molten metal that is determined based on data on a plan for the molten metal, which data correspond to the serial number for the mold, differs from the material of the molten metal that is determined based on the data on the conditions of the molten metal, which molten metal is linked with the serial number for the ladle.

17. The casting plant of claim 1, wherein the molding unit or the unit for conveying the mold has a device for engraving that engraves a surface of each cavity of the mold, wherein, when the device for engraving engraves the cavity, the controller for the molding unit or the controller for the unit for conveying the mold issues a serial number for an individual piece to every cavity in the mold, which cavity is engraved, to link the serial number for an individual piece with the serial number for the mold.

18. A method for managing data for molding a mold and data on conditions of molten metal in a casting plant that molds the mold, that conveys the mold to a position for pouring molten metal, and that pours the molten metal from a ladle for pouring located on the pouring machine into the mold, to obtain a cast product, the method comprising the steps of:

issuing a serial number for the mold to the mold;

causing the serial number for the mold to correspond with a position of the mold to which the serial number for the mold has been issued;

linking the serial number for the mold with data on a molding plan for the mold;

shifting the serial number for the mold at the position of the mold that is conveyed when conveyance of the mold by a distance to the next mold is detected;

finding a serial number for a ladle that is assigned to the ladle for pouring located on the pouring machine, which serial number for a ladle is linked with the data on the conditions of the molten metal, which data show data on characteristics for recording the molten metal in the ladle for pouring; and linking the serial number for the ladle of the ladle for pouring with the serial number for the mold when the molten metal is poured from the ladle for pouring into the mold.

19. The method for managing the data of claim 18, further comprising the steps of:

issuing a serial number for a ladle to a ladle for reacting when an alloyed metal is put in the ladle for reacting;

causing the serial number for the ladle to correspond with a position of the ladle for reacting to which the serial number for the ladle has been issued;

linking data on conditions of the molten metal in the ladle for reacting with the serial number for the ladle;

shifting the serial number for the ladle at a position where the ladle for reacting is transported when the ladle for reacting is transported;

linking the serial number for the ladle with the ladle for pouring when the molten metal in the ladle for reacting is transferred to the ladle for pouring; and shifting the serial number for the ladle at a position where the ladle for pouring is transported when the ladle for pouring is transported.

20. The method for managing the data of claim 18, further comprising the steps of:

issuing a serial number for the ladle to the ladle for pouring when an alloyed metal is put into the ladle for pouring;

causing the serial number for the ladle to correspond with a position of the ladle for pouring to which the serial number for the ladle has been issued;

linking data on conditions of the molten metal in the ladle for pouring with the serial number for the ladle; and shifting the serial number for the ladle at a position where the ladle for pouring is transported when the ladle for pouring is transported.

* * * * *